US009403370B2

(12) United States Patent
Takata

(10) Patent No.: US 9,403,370 B2
(45) Date of Patent: Aug. 2, 2016

(54) LIQUID DISCHARGE APPARATUS, LIQUID CARTRIDGE, AND LIQUID DISCHARGE SYSTEM

(71) Applicant: Brother Kogyo Kabushiki Kaisha, Nagoya-shi, Aichi-ken (JP)

(72) Inventor: Masayuki Takata, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/672,408

(22) Filed: Mar. 30, 2015

(65) Prior Publication Data

US 2015/0273839 A1 Oct. 1, 2015

(30) Foreign Application Priority Data

Mar. 31, 2014 (JP) ..... 2014-071157

(51) Int. Cl.

| | |
|---|---|
| ***B41J 2/175*** | (2006.01) |
| ***B41J 2/17*** | (2006.01) |
| ***B41J 29/02*** | (2006.01) |
| ***B41J 29/13*** | (2006.01) |

(52) U.S. Cl.

CPC ..... *B41J 2/175* (2013.01); *B41J 2/17513* (2013.01); *B41J 29/02* (2013.01); *B41J 29/13* (2013.01)

(58) Field of Classification Search

CPC .... B41J 2/17596; B41J 2/175; B41J 2/17513; B41J 2/17556; B41J 2/18; B41J 2/17566; B41J 2/17506; B41J 2/17503; B41J 2/17509; B41J 2/17593; B41J 2/17523; B41J 2/1752

See application file for complete search history.

(56) References Cited

U.S. PATENT DOCUMENTS

| | | | | |
|---|---|---|---|---|
| 8,272,721 | B2 * | 9/2012 | Umeda | B41J 2/17509 347/85 |
| 2006/0192820 | A1 * | 8/2006 | Umeda | B41J 2/17509 347/85 |
| 2010/0214384 | A1 * | 8/2010 | Takata | B41J 2/175 347/94 |
| 2012/0249692 | A1 | 10/2012 | Kanbe et al. | |

FOREIGN PATENT DOCUMENTS

| | | |
|---|---|---|
| JP | 3739840 | 11/2005 |
| JP | 2012-206374 | 10/2012 |

* cited by examiner

*Primary Examiner* — Jannelle M Lebron
(74) *Attorney, Agent, or Firm* — Frommer Lawrence & Haug LLP

(57) ABSTRACT

There is provided a liquid discharge apparatus including a liquid jet head, and a liquid supply unit configured to supply the first liquid to the liquid jet head. The liquid supply unit includes an atmosphere connection portion having a containment portion, an atmosphere communication membrane, and a second liquid contained in the containment portion. The atmosphere connection portion is configured to let the second liquid depart from at least a part of the atmosphere communication membrane under a condition that nozzles of the liquid jet head are positioned above a liquid connection portion of the cartridge installation portion, and is also configured to let the second liquid cover the entire area of the atmosphere communication membrane under a condition that the nozzles of the liquid jet head are positioned below the liquid connection portion of the cartridge installation portion.

17 Claims, 13 Drawing Sheets

(FIRST POSTURE)

(SECOND POSTURE)

(SECOND POSTURE)

(FIRST POSTURE)

(FIRST POSTURE)

(FIRST POSTURE)

(SECOND POSTURE)

(THIRD POSTURE)

LIQUID DISCHARGE APPARATUS, LIQUID CARTRIDGE, AND LIQUID DISCHARGE SYSTEM

CROSS REFERENCE TO RELATED APPLICATION

The present application claims priority from Japanese Patent Application No. 2014-071157 filed on Mar. 31, 2014, the disclosure of which is incorporated herein by reference in their entirety.

BACKGROUND

1. Field of the Invention

The present invention relates to a liquid discharge apparatus jetting a liquid, a liquid cartridge installed in the liquid discharge apparatus, and a liquid discharge system including the liquid discharge apparatus and the liquid cartridge.

2. Description of the Related Art

As one example of liquid discharge apparatuses, there is known an ink jet printer having, for example, an ink jet head, and a cartridge installation portion connected with the ink jet head via a tube. An ink cartridge is detachably installed in the cartridge installation portion. Via the tube, the ink jet head is supplied with ink in the ink cartridge installed in the cartridge installation portion. The ink supplied to the ink jet head is jetted from a plurality of nozzles to a sheet of recording paper.

The cartridge installation portion has an ink connection portion and an atmosphere connection portion connected with the ink cartridge. With the atmosphere connection portion connected with the ink cartridge, an ink chamber of the ink cartridge comes to communicate with the atmosphere. In this state, with the ink connection portion connected with the ink cartridge, it is possible for the ink in the ink chamber to flow out from the ink connection portion.

The atmosphere connection portion has an opening in communication with the ink cartridge, an opening (atmosphere communication port) in communication with the atmosphere, and a space linking those two openings. The atmosphere communication port is provided with a semipermeable membrane. This semipermeable membrane allows a gaseous matter (air) to pass through but does not allow the ink to pass through.

With respect to such an ink jet printer, when the printer is inclined with the ink cartridge being installed, then the ink is liable to flow out from the ink cartridge into the space of the atmosphere connection portion. In this case, because the atmosphere communication port of the atmosphere connection portion is provided with the semipermeable membrane not allowing the ink to pass through, the ink is prevented from leaking out from the atmosphere communication port.

SUMMARY

Many printers are designed such that the plurality of nozzles of the ink jet head may be positioned above the ink connection portion of the cartridge installation portion when any of the printers assumes an ordinary posture in use for recording images or the like on the recording paper. By virtue of this, when the printer assumes the ordinary posture in use, a negative pressure acts on the ink in the nozzles due to a difference in height between the nozzles and the ink connection portion. Therefore, the ink is less likely to leak out from the nozzles because only a slight vibration happening to the printer has broken the meniscus of the ink in the nozzles.

Nevertheless, when the printer is transported to another place or the like for making a physical move, repairing, or the like, it is conceivable to move the printer with the ink cartridge installed but in a different posture from the ordinary posture in use. Because the printer has changed in posture, when the plurality of nozzles of the ink jet head come to be positioned below the ink connection portion of the cartridge installation portion, then the ink is liable to leak out from the nozzles because conversely a positive pressure acts on the ink in the nozzles.

In this respect, with respect to the ink jet printer described above, when the printer is inclined, with the semipermeable membrane provided on the atmosphere communication port of the atmosphere connection portion, the ink is prevented from flowing out from the atmosphere communication port. However, when the printer is inclined to assume the posture in which the nozzles are positioned below the ink connection portion, it is not decisively known whether the ink has flowed into the atmosphere connection portion to adhere constantly to the semipermeable membrane or the ink has further covered the entire area of the semipermeable membrane. According the knowledge of the inventor, when the printer is inclined, if part of the semipermeable membrane is opened (to allow air to pass through), then because the ink cartridge is kept in communication with the atmosphere, the ink may possibly flow out from the ink cartridge toward the ink jet head. Therefore, as described earlier, in the situation for the positive pressure to act on the ink in the nozzles, the ink is more likely to leak out from the nozzles.

Accordingly, it is an object of the present teaching to restrain a liquid from flowing out from a liquid cartridge to a liquid jet head when a liquid discharge apparatus is changed in posture with the liquid cartridge being installed, thereby preventing the liquid from leaking out from nozzles of the liquid jet head.

According to a first aspect of the present teaching, there is provided a liquid. discharge apparatus configured to discharge first liquid, including:

a liquid jet head in which a plurality of nozzles are formed to jet the first liquid; and a liquid supply unit configured to supply the first liquid to the liquid jet head, and including:

a liquid connection portion through which the first liquid is supplied to the liquid jet head, and an atmosphere connection portion through which the first liquid in the liquid supply unit is communicated with the atmosphere;

wherein the atmosphere connection portion includes:

a containment portion which communicates with the liquid retaining chamber in the liquid cartridge and in which an atmosphere communication port is formed, an atmosphere communication membrane provided in the containment portion to block the atmosphere communication port and to allow only gaseous matters to pass through, and a second liquid contained in the containment portion, of which amount is set such that the second liquid does not cover an entire area of the atmosphere communication membrane under a condition that the liquid discharge apparatus assumes a first posture in which the nozzles of the liquid jet head are positioned above the liquid connection portion, and that the second liquid covers the entire area of the atmosphere communication membrane under a condition that the liquid discharge apparatus assumes a second posture in which the nozzles of the liquid jet head are positioned below the liquid connection portion of the cartridge installation portion, and wherein the atmosphere connection portion is configured to let the second liquid depart from a least apart of the atmosphere communication membrane under a condition that the liquid discharge apparatus assumes the first posture, and the atmosphere connection portion is also configured to let the second liquid cover the entire area of the atmosphere communication membrane under a condition that the liquid discharge apparatus assumes the second posture.

According to the present teaching, when the liquid discharge apparatus assumes the first posture, in the atmosphere connection portion, the second liquid does not cover the entire area of the atmosphere communication membrane so that the atmosphere communication port is opened. Therefore, the liquid retaining chamber of the liquid cartridge is in communication with the atmosphere. Accordingly, it is possible for the first liquid to flow out from the liquid cartridge to the liquid jet head. Further, the first posture of the liquid discharge apparatus refers to the posture when the first liquid is supplied from the liquid cartridge to the liquid jet head such that the liquid may be jetted from the plurality of nozzles of the liquid jet head. Further, when the liquid discharge apparatus assumes the first posture, the plurality of nozzles of the liquid jet head are positioned above the liquid connection portion of the cartridge installation portion such that due to the difference in height, a negative pressure arises inside the liquid jet head. Hence, it is less likely to break the meniscus of the nozzles so as to cause the liquid to flow out from the nozzles.

On the other hand, when the liquid discharge apparatus assumes the second posture different from the first posture, the plurality of nozzles of the liquid jet head are positioned below the liquid connection portion of the cartridge installation portion. Therefore, due the above difference in height, conversely a positive pressure acts on the liquid in each nozzle. Hence, it is more likely to break the meniscus of the nozzle so that the liquid is liable to flow out from the nozzle. According to the present teaching, however, when the liquid discharge apparatus assumes the second posture, the second liquid covers the entire area of the atmosphere communication membrane of the atmosphere connection portion. By virtue of this, because the communication is shut off between the atmosphere and the liquid retaining chamber of the liquid cartridge, it is not possible for the liquid in the liquid cartridge to flow out to be supplied to the liquid jet head. Accordingly, even if the plurality of nozzles of the liquid jet head are positioned below the liquid connection portion of the cartridge installation portion, the liquid is still prevented from flowing out from the nozzles.

According to a second aspect of the present teaching, there is provided a liquid cartridge to be installed in a liquid discharge apparatus including a liquid jet head having a plurality of nozzles jetting a first liquid, the liquid cartridge including:

a cartridge body in which a liquid retaining chamber is formed to retain the first liquid;

a liquid supply portion provided in the cartridge body and configured to supply a liquid to the liquid discharge apparatus; and an atmosphere communication portion provided in the cartridge body to cause the liquid retaining chamber in the cartridge body to communicate with the atmosphere, wherein the atmosphere communication portion includes:

a containment portion which communicates with the liquid retaining chamber in the cartridge body and in which an atmosphere communication port is formed, an atmosphere communication membrane provided in the containment portion to block the atmosphere communication port, and a second liquid contained in the containment portion; and wherein the atmosphere communication portion is configured to let the second liquid depart from at least a part of the atmosphere communication membrane under a condition that the liquid cartridge assumes a first cartridge posture, and is configured to let the second liquid cover the entire area of the atmosphere communication membrane under a condition that the liquid cartridge assumes a second cartridge posture.

According to the present teaching, when the liquid cartridge assumes the first cartridge posture, because the second liquid is apart from the atmosphere communication membrane, the liquid retaining chamber in the liquid cartridge is in communication with the atmosphere such that it is possible for the liquid to flow out from the liquid supply portion. On the other hand, when the liquid cartridge assumes the second cartridge posture, the second liquid covers the entire area of the atmosphere communication membrane. That is, because the liquid retaining chamber of the liquid cartridge is shut off from the atmosphere, it is not possible for the liquid to flow out from the liquid supply portion. Therefore, when the liquid cartridge assumes the second cartridge posture, it is possible to prevent the liquid from flowing out from the liquid cartridge.

According to a third aspect of the present teaching, there is provided a liquid discharge system including:

the liquid cartridge according to the second aspect of the present teaching;

a liquid jet head having a plurality of nozzles to jet the first liquid; and a liquid jet head having a plurality of nozzles to jet the first liquid; and a cartridge installation portion being connected with the liquid jet head and configured to install the liquid cartridge, wherein the liquid cartridge installed in the cartridge installation portion assumes the first cartridge posture under a condition that the liquid discharge apparatus assumes a first posture in which the nozzles of the liquid jet head are positioned above the liquid connection portion of the cartridge installation portion, whereas the liquid cartridge installed in the cartridge installation portion assumes the second cartridge posture under a condition that the liquid discharge apparatus assumes a second posture in which the nozzles of the liquid jet head are positioned below the liquid connection portion of the cartridge installation portion.

According to the present teaching, when the liquid discharge apparatus assumes the first posture, the liquid cartridge assumes the first cartridge posture and, in the atmosphere communication portion of the liquid cartridge, the atmosphere communication port is opened. Therefore, the liquid retaining chamber in the liquid cartridge is in communication with the atmosphere. Accordingly, it is possible for the first liquid to flow out from the liquid cartridge to the liquid jet head. Further, when the liquid discharge apparatus assumes the first posture, the plurality of nozzles of the liquid jet head are positioned above the liquid connection portion of the cartridge installation portion. Therefore, even if some vibration is exerted thereon, it is still less likely to break the meniscus of the nozzles on that the liquid is less likely to flow out from the nozzles.

On the other hand, when the liquid discharge apparatus assumes the second posture, the plurality of nozzles of the liquid jet head are positioned below the liquid connection portion of the cartridge installation portion. According to the present teaching, however, if the liquid discharge apparatus assumes the second posture, then the liquid cartridge assumes the second cartridge posture and, on this occasion, the second liquid covers the entire area of the atmosphere communication membrane in the atmosphere communication portion of the liquid cartridge. By virtue of this, the communication is shut off between the atmosphere and the liquid retaining chamber of the liquid cartridge. Hence, it is not possible for the liquid to flow out from the liquid supply portion of the liquid cartridge. That is, because the liquid is no longer supplied to the liquid jet head, the liquid is prevented from flowing out from the nozzles of liquid jet head.

DESCRIPTION THE EMBODIMENTS

<First Embodiment>

Next, a first embodiment of the present teaching will be explained. In the first embodiment, one print system 100 (the liquid discharge system of the present teaching) is constructed from a printer 1 (the liquid discharge apparatus of the present teaching), and four ink cartridges 10 (the liquid cartridge of the present teaching) installed in the printer 1.

Figure 1:
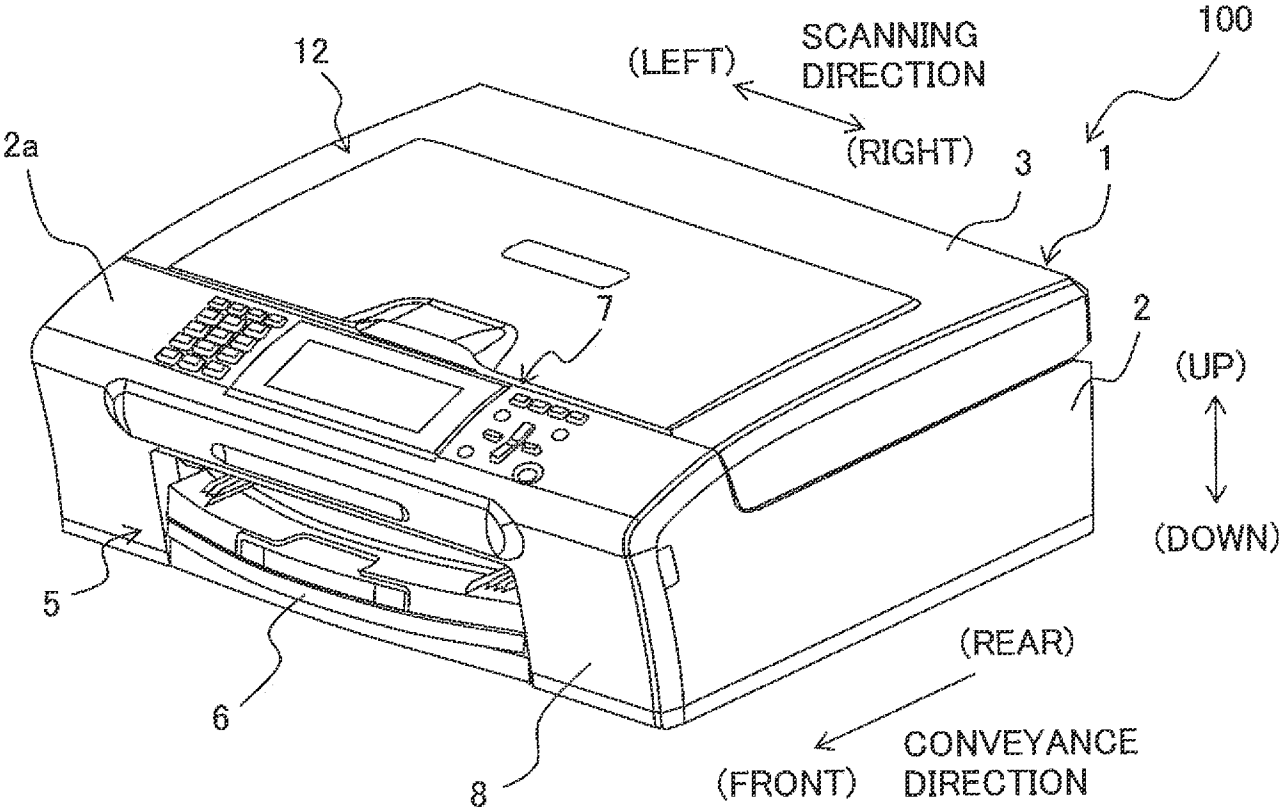
FIG. 1 is a perspective view of a printer (printer system) with an ink cartridge installed therein, according to a first embodiment of the present invention.

In the following explanation on a configuration of the print system 100 constructed from the printer 1 and the ink cartridges, when the printer 1 assumes a posture for ordinary use (also to be referred to as a first posture, below) in recording images and the like as shown in FIG. 1, the upward and downward directions, the leftward and rightward directions, and the frontward and rearward directions are defined, respectively, as the up-down direction, the left-right direction, and the front-rear direction. Further, when the printer 1 changes in posture, then as will be explained later on, the direction changes from that in the first posture, but it will be described each time an explanation is made on the posture of the printer 1.

<A Schematic Configuration of the Printer>

Figure 2:
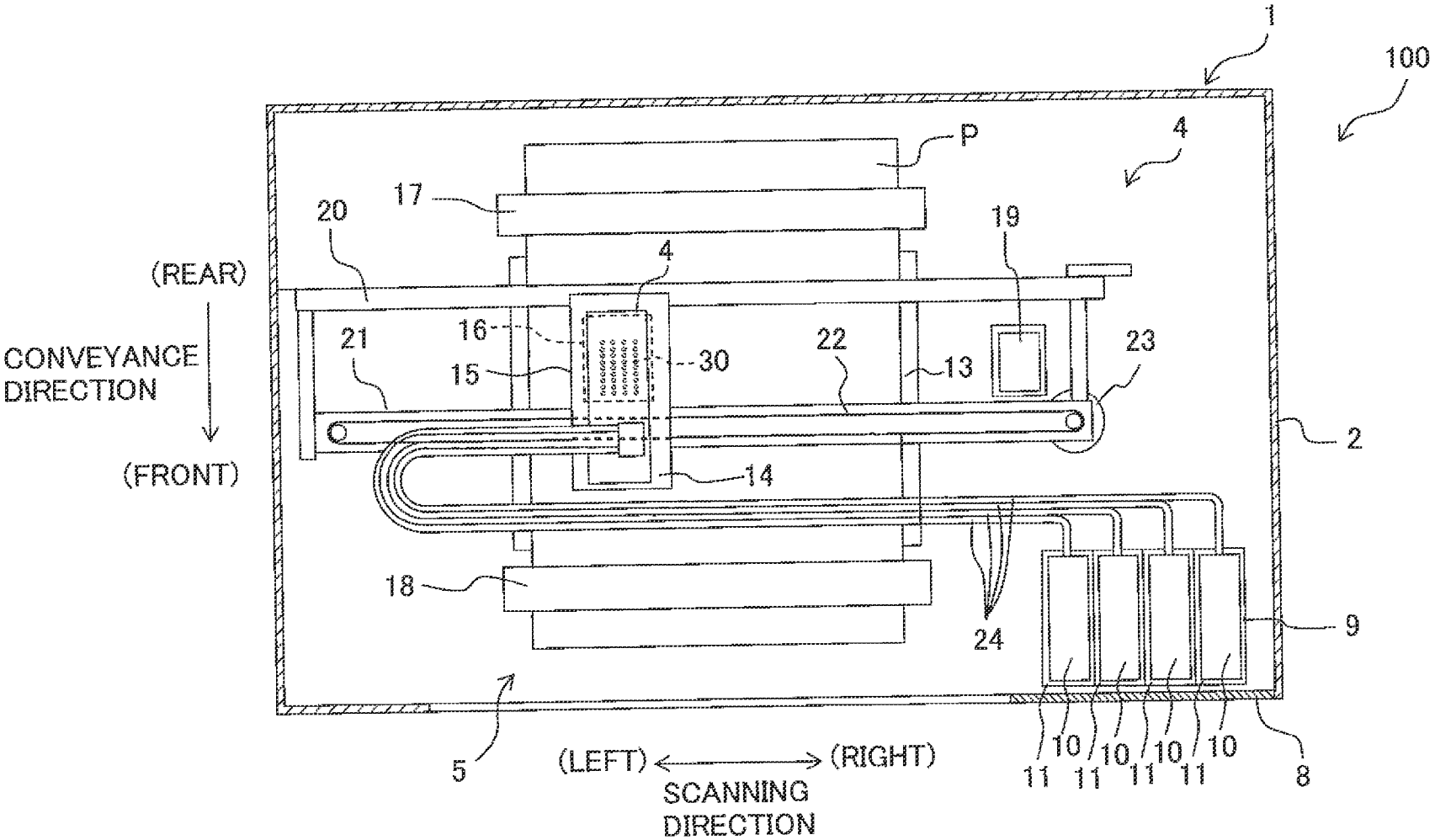
FIG. 2 is a schematic top view of the inside of the printer of FIG. 1.

First, a schematic configuration of the printer 1 will be explained. As shown in FIGS. 1 and 2, the printer 1 has a printer casing 2, a cover 3 fitted on the printer casing 2 in a swingable manner, and a printer portion 4 adapted to record images on recording paper P.

As shown in FIG. 1, in a front portion of the printer casing 2, a paper discharge portion 5 is formed to open in the front side. A paper feed cassette 6 is arranged below the paper discharge portion 5 to contain the recording paper P. As shown in FIG. 2, the printer portion 4 is contained in the printer casing 2. The recording paper P in the paper feed cassette 6 is taken out by an unshown paper feed mechanism to supply the printer portion 4. The printer portion 4 records images on the recording paper P supplied by the paper feed mechanism. The recording paper P with the images recorded in the printer portion 4 is discharged from the paper discharge portion 5.

An inclined surface 2*a* is formed in such a portion of the printer casing 2 as at the front side of the cover 3, and an operation panel 7 is arranged on the inclined surface 2*a*.

Further, a lid 8 is fitted in such a portion of the printer casing 2 at the right side of the paper discharge portion 5. A holder 9 is arranged on the rear side of the lid 8. The holder 9 includes four cartridge installation portions 11 in which ink cartridges 10 are installed respectively for four colors (black, yellow, cyan, and magenta). Further, an explanation will be made later on detailed configurations of the ink cartridges 10, and the cartridge installation portions 11 of the holder 9 to install the ink cartridges 10 therein.

The cover 3 is arranged above the printer casing 2 to cover the internal mechanisms such as the printer portion 4 and the like contained within the printer casing 2. Further, the cover 3 is fitted on the printer casing 2 at its rear end portion to be able to swing or pivot upward and downward or to turn up and down. By virtue of this, on the occasion of releasing a paper jam, maintenance and inspection, or the like, it is possible to uncover the inside of the printer casing 2 by pivoting the cover 3 upward. Further, although a detailed explanation is omitted, the cover 3 is provided with a scanner portion 12 including an image scanner adapted to read in images and the like recorded on a document. That is, the printer 1 in the first embodiment is configured as a multifunction peripheral capable of carrying out printing, scanning, photocopying, etc.

Next, the printer portion 4 will be explained. As shown in FIG. 2, an unshown paper feed mechanism supplies the printer portion 4 with the recording paper P contained in the paper feed cassette 6 from the rear side one sheet by one sheet. The printer portion 4 has a platen 13, a carriage 14, a sub-tank 15, an ink jet head 16, two conveyance rollers 17 and 18, a cap 19, and the like.

The platen 13 is arranged in the printer casing 2 to assume a horizontal posture. The recording paper P is positioned on the upper surface of the platen 13. Above the platen 13, two guide rails 20 and 21 are provided to extend in parallel with a scanning direction. The carriage 14 is connected to a carriage drive motor 23 via an endless belt 22. When the belt 22 is driven by the carriage drive motor 23, the carriage 14 moves in a left-right direction (also to be referred to as the scanning direction) along the two guide rails 20 and 21 in a region facing the recording paper P on the platen 13.

Figure 3:
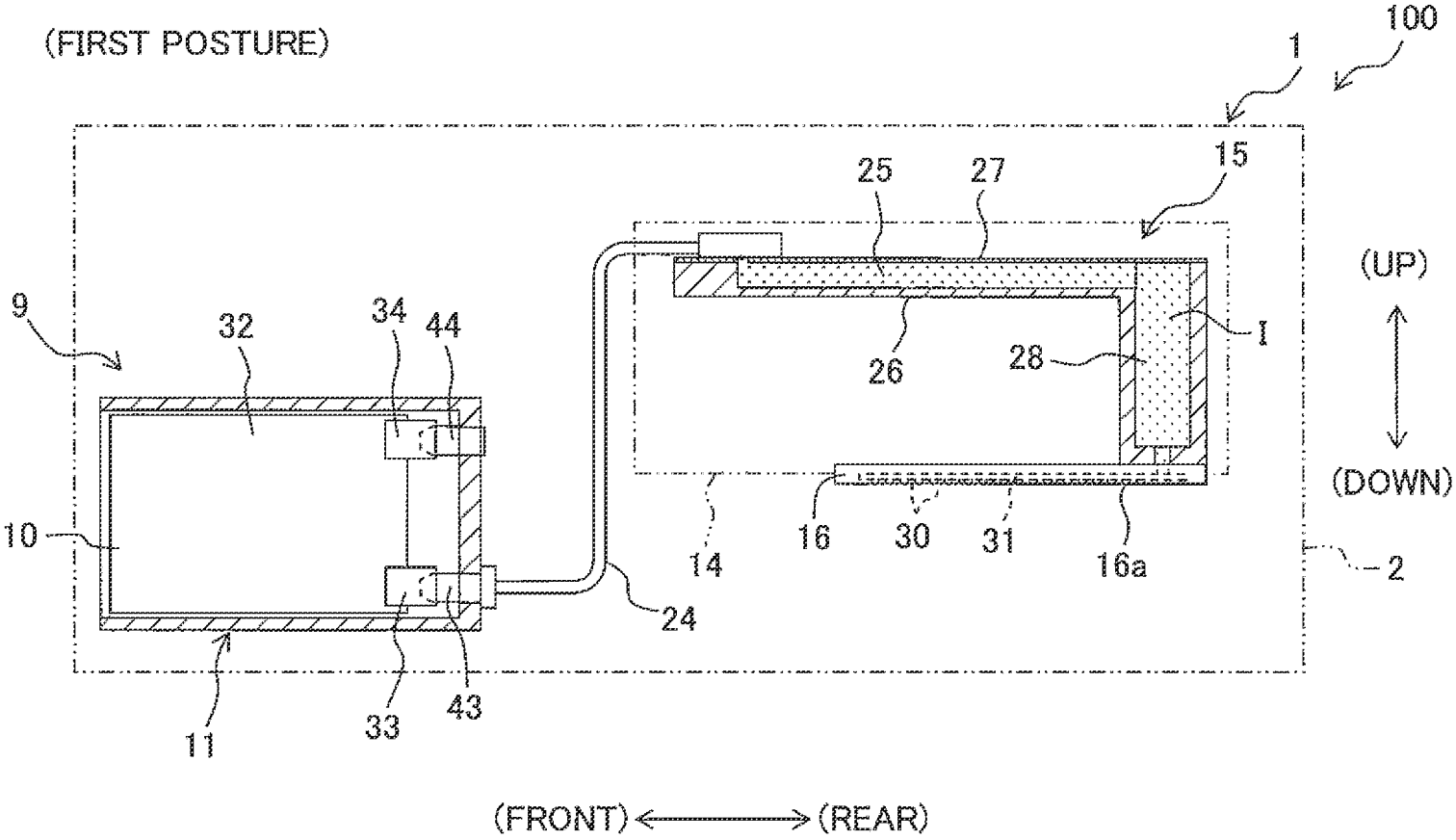
FIG. 3 is a lateral view of the main part of the printer assuming a first posture for ordinary use.

The sub-tank 15 is mounted on the carriage 14. The sub-tank 15 is connected with the four cartridge installation portions 11 of the holder 9 via four tubes 24, and supplied respectively with the four color inks from the holder 9. As shown in FIG. 3, the sub-tank 15 has a body member 26 in which an ink channel 28 is formed to include a damper chamber 25, and a flexible film 27 attached to the body member 26 to cover the damper chamber 25. Along with the carriage 14 moving in the scanning direction, when a pressure variation of ink I occurs in the ink channel 28 in the sub-tank 15, the film 27 deforms with the damper chamber 25. In this manner, along with the carriage 14 moving in the scanning direction, the pressure variation of the ink I is damped by the film 27 of the damper chamber 25.

As shown in FIG. 3, the ink jet head 16 (the liquid jet head of the present teaching) is fitted on the lower end of the sub-tank 15. The ink jet head 16 has a plurality of nozzles 30 formed in its lower surface (to be referred to as an ink jet surface 16*a*, below). Further, the ink jet head 16 has an ink channel 31 in communication with the plurality of nozzles 30. The ink channel 31 is in communication with the ink channel 28 in the sub-tank 15 to be supplied with the ink from the sub-tank 15. Further, the ink jet head 16 includes an actuator (not depiced) adapted to impart jet energy respectively to the ink in the plurality of nozzles 30. The actuator is not limited to any particular configuration. However, it is possible to adopt, for example, a piezoelectric actuator, a bubble jet actuator or the like which utilizes a distortion occurring in a piezoelectric element when an electric voltage is applied thereto. In the first embodiment, a piezoelectric actuator is adopted. This actuator causes the ink jet head 16 to jet the ink individually from the plurality of nozzles 30 by imparting the jet energy respectively to the ink in the plurality of nozzles 30.

Further, as depicted in FIG. 3, when the printer 1 assumes the first posture which is the posture for ordinary use as depicted in FIG. 1, the ink jet surface 16*a* of the ink jet head 16 is positioned above an ink connection portion 43 of the cartridge installation portion 11 in connection with the ink cartridge 10. Therefore, this difference in height causes a negative pressure to act on the ink in the plurality of nozzles 30 of the ink jet head 16. Hence, even if a little vibration is exerted on the ink jet head 16, it is still less likely to break the meniscus of each nozzle 30 so as to cause the ink to flow out from the nozzles 30.

As depicted in FIG. 2, the two conveyance rollers 17 and 18 are arranged in the front and rear sides to interpose the platen 13 and carriage 14 therebetween. A transport motor (not depicted) synchronizes the conveyance rollers 17 and 18 with each other and drives the both to rotate. The conveyance rollers 17 and 18 cooperate to convey the recording paper P positioned on the platen 13 in a frontward direction (also to be referred to as a conveyance direction).

The cap 19 is arranged in a position on the right side of the platen 13 to face the ink jet surface 16*a* of the ink jet head 16 when the carriage 14 comes to this position. The cap 19 is driven to move up and down by a cap raising and lowering mechanism (not depicted), and thus is separable from and contactable with the ink jet surface 16*a* of the ink jet head 16. Further, a suction pump(not depicted) is connected to the cap 19.

The cap 19 mainly plays the following two roles. First, it resolves jet defection of the nozzles 30 of the ink jet head 16. It is possible for the cap 19 to come to contact closely with the ink jet surface 16*a* of the ink jet head 16 to cover the plurality of nozzles 30 so as to let the suction pump carry out suction. At this time, the ink jet head 16 discharges dusts, air bubbles and/or thickened ink in the nozzles 30 and ink channel 31 from the plurality of nozzles 30, together with the ink. The other role of the cap 19 is to restrain the ink from drying in the plurality of nozzles 30 by a close contact with the ink jet surface 16*a* to cover the plurality of nozzles 30 when the ink jet head 16 is not in use.

The printer portion 4 explained earlier records images on the recording paper P in the following manner. First, it moves the carriage 14 in the scanning direction while respectively jetting the ink from the plurality of nozzles 30 of the ink jet head 16 to the recording paper P on the platen 13. Further, the printer portion 4 causes the two conveyance rollers 17 and 18 to convey the recording paper P in the conveyance direction by a predetermined length. By alternately repeating the ink jet operation of the ink jet head 16 and the conveyance of the recording paper P with the conveyance rollers 17 and 18, desired images are recorded on the recording paper P.

<Configuration of the Ink Cartridges>

Figure 4:
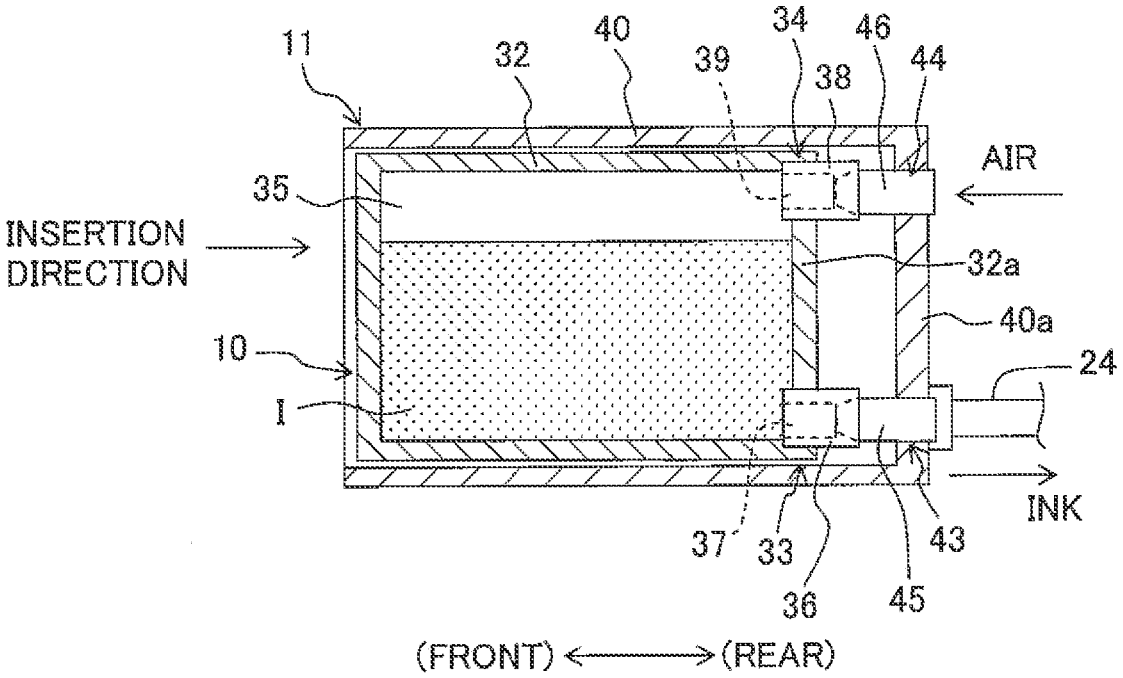
FIG. 4 is a vertical cross-sectional view of the ink cartridge and a cartridge installation portion.

Next, a detailed configuration of the ink cartridges 10 will be explained. Further, because the four (four-color) ink cartridges 10 have the same configuration, one of them is taken as the representative for the explanation. As depicted in FIG. 4, the ink cartridge 10 has a cartridge body 32, an ink supply portion 33, and an atmosphere communication portion 34.

The cartridge body 32 is a cuboid shaped member formed of a synthetic resin material. Inside the cartridge body 32, an ink retaining chamber 35 (the liquid retaining chamber of the present teaching) is formed to retain the ink (indicated by the letter "I" in FIG. 3). Further, in an unused ink cartridge 10, the ink retaining chamber 35 is also not filled entirely with the ink I but, as depicted in FIG. 4, there is some air in an upper part of the ink retaining chamber 35. The ink supply portion 33 and the atmosphere communication portion 34 are both provided in a wall portion 32*a* of the cartridge body 32 on the rear side. The ink supply portion 33 is fitted in a lower portion of the wall portion 32*a* whereas the atmosphere communication portion 34 is fitted in an upper portion of the wall portion 32*a*.

The ink supply portion 33 has a cylindrical ink supply body 36, and an ink supply valve 37 contained in the ink supply body 36. The ink supply body 36 has an internal passage in communication with a lower portion of the ink retaining chamber 35. The ink supply valve 37 is provided for opening and closing the passage in the ink supply body 36. The atmosphere communication portion 34 has a cylindrical atmosphere communication body 38, and an atmosphere communication valve 39 contained in the atmosphere communication body 38. The atmosphere communication body 38 has an internal passage in communication with an upper portion of the ink retaining chamber 35 filled with the air. Further, the atmosphere communication valve 39 is provided to open and close the passage in the atmosphere communication body 38.

<A Configuration of the Cartridge Installation Portions of the Holder>

Next, a detailed configuration of the cartridge installation portions 11 of the holder 9 will be explained. The holder 9 has the four cartridge installation portions 11 in which the four (four-color) ink cartridges 10 are installed respectively. As depicted in FIG. 1, the four cartridge installation portions 11 are arranged to align in the left-right direction. Further, the four cartridge installation portions 11 also have the same configuration just as the aforementioned ink cartridges 10. Therefore, one of the four cartridge installation portions 11 is taken as the representative for the explanation. As depicted in FIG. 4, the cartridge installation portion 11 has a case member 40, an ink connection portion 43 (the liquid connection portion of the present teaching), and an atmosphere connection portion 44.

The case member 40 has an approximate U-shape with an open front side. The aforementioned ink cartridge 10 is inserted into the case member 40 from the front side. The ink connection portion 43 and the atmosphere connection portion 44 are provided in such a wall portion 40*a* of the case member 40 as positioned on the far side (the rear side) according to the insertion direction. The ink connection portion 43 is fitted in a lower portion of the wall portion 40*a* while the atmosphere connection portion 44 is fitted in an upper portion of the wall portion 40*a,* to project respectively toward the inside of the case member 40.

The ink connection portion 43 has a cylindrical ink connection body 45. The ink connection body 45 has a tapered fore-end portion away from the wall portion 40*a* of the case member 40. The ink connection portion 43 is connected with the sub-tank 15 (see FIG. 3) via the tube 24 connected to the wall portion 40*a* of the case member 40. The atmosphere connection portion 44 also has a cylindrical atmosphere connection body 46. Just as the ink connection body 45, the atmosphere connection body 46 also has a tapered fore-end portion away from the wall portion 40*a* of the case member 40. Further, the atmosphere connection body 46 has such a base end portion at the side of the wall portion 40*a* as in communication with the atmosphere.

When the ink cartridge 10 is inserted into the case member 40 of the cartridge installation portion 11, then the fore-end portion of the ink connection body 45 is pressed into the ink supply body 36 of the ink supply portion 33 of the ink cartridge 10. At this time, the fore-end portion of the ink connection body 45 opens the ink supply valve 37 in the ink supply body 36. This causes a lower space of the ink retaining chamber 35 of the ink cartridge 10 to communicate with the ink connection portion 43 of the cartridge installation portion 11. Further, the fore-end portion of the atmosphere connection body 46 is pressed into the atmosphere communication body 38 of the atmosphere communication portion 34 of the ink cartridge 10. The fore-end portion of the atmosphere connection body 46 opens the atmosphere communication valve 39 in the atmosphere communication body 38 to cause an upper space of the ink retaining chamber 35 of the ink cartridge 10 to communicate with the atmosphere.

Further, the ink cartridge 10 is usually dispatched with the internal ink retaining chamber 35 depressurized at a lower pressure than the atmosphere pressure. Therefore, when the ink cartridge 10 is installed into the cartridge installation portion 11, and when the ink connection portion 43 comes to communicate with the ink retaining chamber 35 earlier than the atmosphere connection portion 44 causes the ink retaining chamber 35 to communicate with the atmosphere, then the ink is liable to flow back into the ink cartridge 10 on the side of the ink jet head 16. Hence, it is preferable that the ink connection portion 43 comes to communicate with the ink retaining chamber 35 at the same time as the atmosphere connection portion 44 causes the ink retaining chamber 35 to communicate with the atmosphere, or that the communication with the atmosphere comes first.

In such a state, when the ink is consumed because the ink jet head 16 jets the ink from the plurality of nozzles 30, then as depicted in FIG. 3, the ink in the ink retaining chamber 35 of the ink cartridge 10 is supplied to the sub-tank 15 and the ink jet head 16 via the ink supply portion 33, the ink connection portion 43, and the tube.

<The Problem of Ink Leaking Out from the Nozzles Due to Posture Change of the Printer>

When the aforementioned printer 1 (the print system 100 including the ink cartridges 10) assumes the horizontal first posture which is the posture for ordinary use, as depicted in FIG. 3, the plurality of nozzles 30 of the ink jet surface 16*a* of the ink et head 16 are positioned above the ink supply portion 33 of the ink cartridge 10 (the ink connection portion 43 of the cartridge installation portion 11). Therefore, in the first posture, due to the difference in height between the ink jet surface 16*a* and the ink supply portion 33, a negative pressure acts on the ink in each nozzle 30. Hence, even when the ink jet head 16 is vibrated or in a like manner, it is still less likely to break the meniscus of the nozzle 30 so as to cause the ink to flow out from the nozzle 30.

Nevertheless, when the printer 1 is transported to another place for making a physical move, repairing, or the like, it is conceivable to change the posture of the printer 1 with the ink cartridges 10 being installed.

Figure 5:
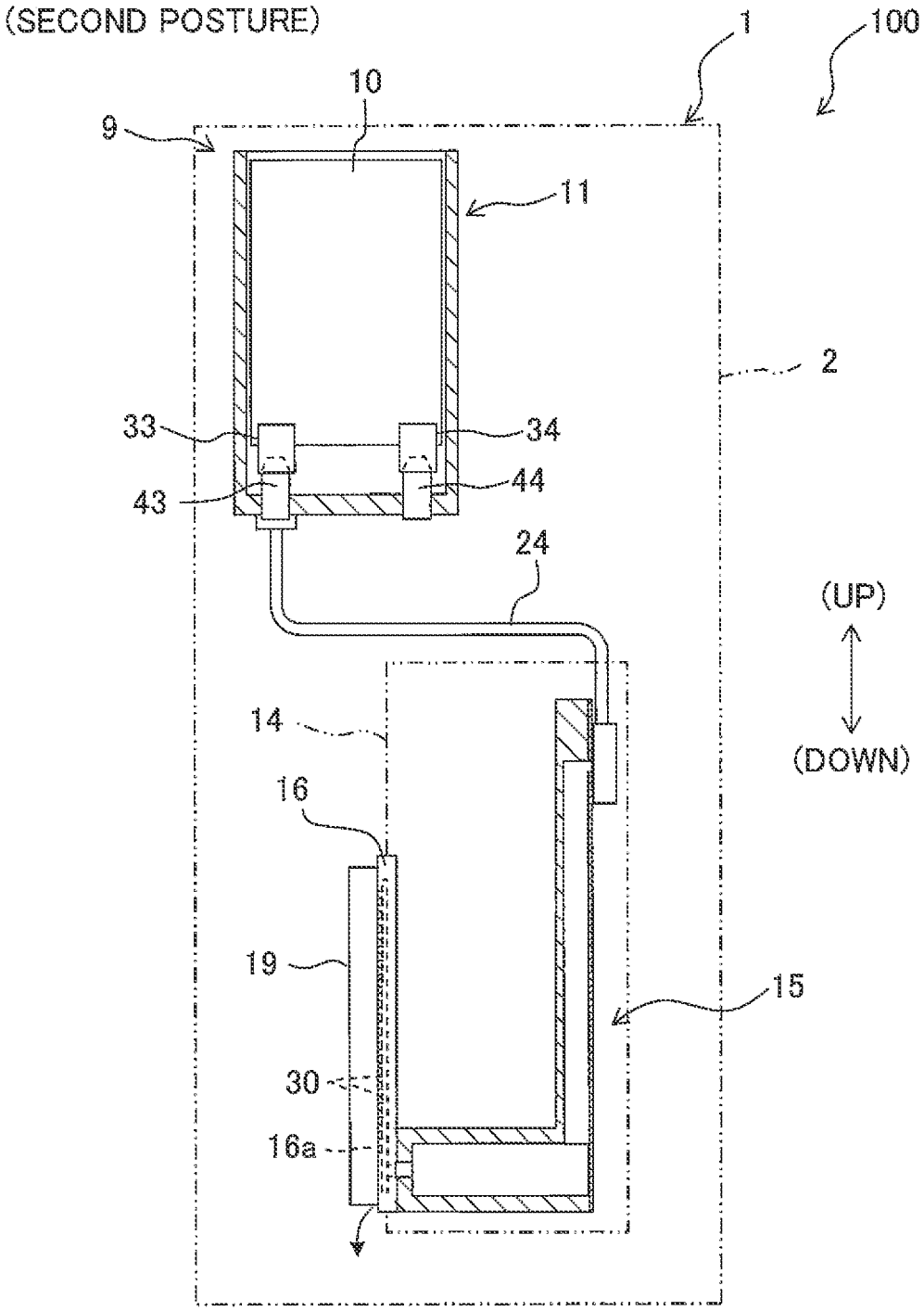
FIG. 5 is a lateral view of the main part of the printer assuming a second posture.

As depicted in FIG. 5, the printer 1 is rotated 90 degrees from the horizontal first posture to assume a vertical second posture for the front part in the first posture (the part where the paper discharge portion 5 is provided in FIG. 1) to locate on the upper side. On this occasion, the plurality of nozzles 30 of the ink jet head 16 are positioned below the ink supply portion 33 of the ink cartridge 10 (the ink connection portion 43 of the cartridge installation portion 11). Hence, due to the difference in height as mentioned earlier, a positive pressure acts on the ink in each nozzle 30. At this time, because it is more likely to break the meniscus of the nozzle 30, the ink is liable to flow out from the nozzle 30. Further, as depicted in FIG. 5, with respect to the printer 1 in the first embodiment, when the ink jet head 16 is not in use, the cap 19 covers the plurality of nozzles 30 of the ink jet surface 16*a*. However, even when the cap 19 covers the plurality of nozzles 30, as indicated by the arrow in FIG. 5, the ink is still liable to leak out from the interspace between the ink jet surface 16*a* and the cap 19. Further, when the printer 1 has assumed the second posture as it is for a long time, then the cap 19 is liable to be internally full of the ink which has since leaked out from the nozzles 30. When the ink leaks out from the nozzles 30 to exceed the inner volume of the cap 19, then the ink will overflow from the cap 19.

In order to prevent such kind of problems from happening, the printer 1 of the first embodiment shuts off the communication between the ink cartridge 10 and the atmosphere in the atmosphere connection portion 44 of the cartridge installation portion 11 when the printer 1 assumes the second posture. This prevents the ink from flowing out from the ink cartridge 10 to the ink jet head 16.

<A Detailed Configuration of the Atmosphere Connection Portion>

Figure 6A:
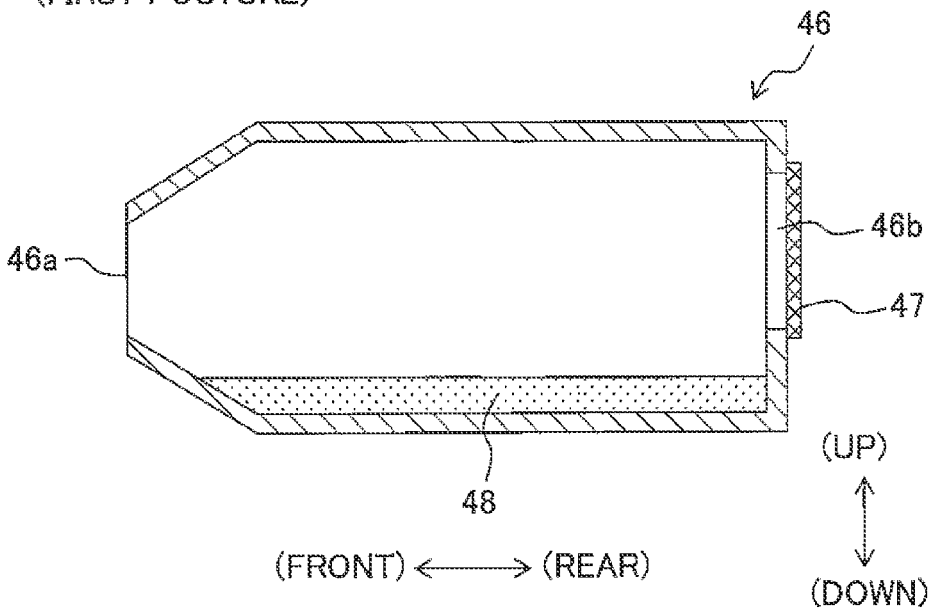
FIG. 6A is a cross-sectional view of an atmosphere connection body when the printer assumes the first posture.
Figure 6B:
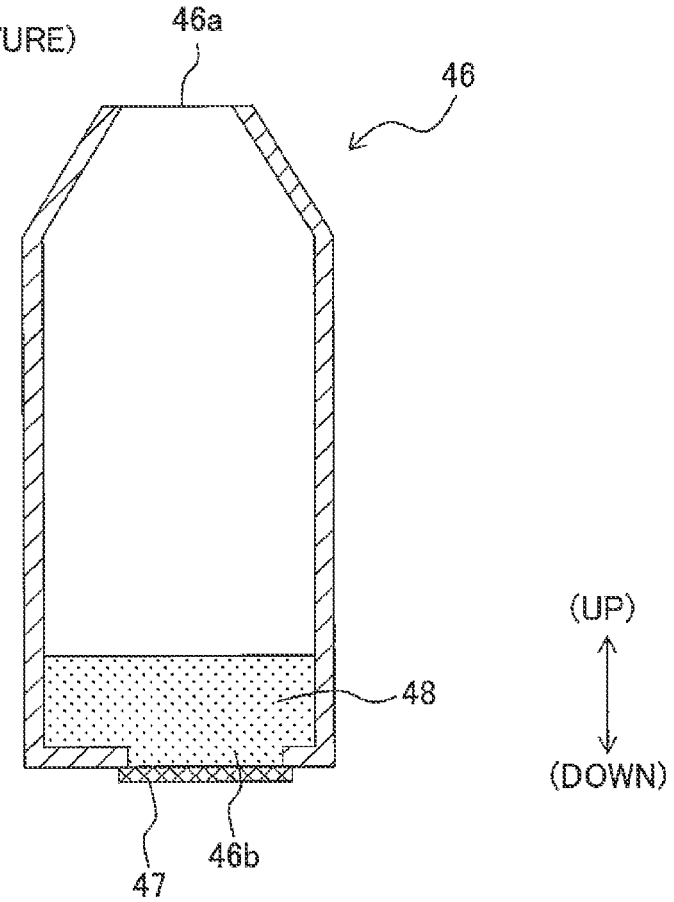
FIG. 6B is a cross-sectional view of the atmosphere connection body when the printer assumes the second posture.

As described earlier on, the atmosphere connection portion 44 has the cylindrical atmosphere connection body 46 (corresponding to the containment portion of the present teaching). As depicted in FIGS. 6A and 6B, the cylindrical atmosphere connection body 46 has a tapered fore-end portion at which a connection port 46*a* is formed to connect with the atmosphere communication portion 34 of the ink cartridge 10. The tapered angle of the tapered end portion is set such that the sealing liquid 48 as described below can not reach the connection port 46*a* to overflow from the connection port 46*a,* when the printer 1 assumes the first posture depicted in FIG. 3. The atmosphere connection body 46 has an internal space in communication with the ink retaining chamber 35 of the ink cartridge 10 via the connection port 46*a*.

An atmosphere communication port 46*b* is formed at the base end of the atmosphere connection body 46. Further, the atmosphere connection body 46 is provided with an atmosphere communication membrane 47 to block the atmosphere communication port 46*b*. The atmosphere communication membrane 47 is a porous membrane having minute holes, and is made of a fluoroethylene resin such as polytetrafluoroethylene, polychlorotrifluoroethene, tetrafluoroethylene-hexafluoropropylene copolymer, tetrafluoroethylene-perfluoroalkylvinylether copolymer, tetrafluoroethylene-ethylene copolymer, or the like. The atmosphere communication membrane 47 allows gaseous matters to pass through but does not allow liquids to pass through, and is also referred to as a semipermeable membrane or a gas-liquid separation membrane.

A sealing liquid 48 (corresponding to the second liquid of the present teaching) is contained in the internal space of the atmosphere connection body 46. There is only a small amount of the seating liquid 48 inside the atmosphere connection body 46, for example, just ⅕ or so of the inner volume of the atmosphere connection body 46. The sealing liquid 48 may be any kind of liquid such as, for example, the same as the ink to be jetted from the nozzles 30. In the first embodiment, however, the sealing liquid 48 is supposed to be a liquid different from the ink (corresponding to the first liquid of the present teaching) retained in the ink cartridge 10.

The ink jetted from the nozzles 30 is a mixture of a liquid constituent and a solid constituent in which a color material of black or the like (the solid constituent) is mixed. into a solvent (the liquid constituent) whose primary constituent is water. In contrast to this, the sealing liquid 48 is also a mixture of the same solvent and color material as the ink, but the content of the color material is lower than the ink. Further, while the color material of an ink usually includes a dye and/or a pigment, the color material in the first embodiment may be any of a dye and a pigment. A dye dissolves in a waterborne solvent, whereas a pigment does not dissolve in a waterborne solvent but exists dispersedly in the solvent. In this manner, while the existent form in a solvent is different between a dye and a pigment, any of the dye color material and the pigment color material is treated as "mixed" in a solvent in the first embodiment.

When the printer 1 assumes the first posture in FIG. 3, as depicted in FIG. 6A, the atmosphere connection body 46 assumes such a posture as to extend in a horizontal direction. On this occasion, the sealing liquid 48 stays in a bottom part of the atmosphere connection body 46 to locate below the connection port 46*a* and the atmosphere communication port 46*b*. That is, the sealing liquid 48 stays away from and thus does not contact with the atmosphere communication membrane 47 such that the atmosphere communication membrane 47 is not blocked by the sealing liquid 48. Therefore, the ink retaining chamber 35 of the ink cartridge 10 is in communication with the atmosphere via the atmosphere communication membrane 47 such that it is possible for the ink in the ink retaining chamber 35 to flow out from the ink supply portion 33.

Further, when the printer 1 assumes the first posture as in FIG. 6A, the sealing liquid 48 may contact with part of the atmosphere communication membrane 47. On such an occasion, however, the sealing liquid 48 impedes air from flowing in from the atmosphere communication port 46*b* to the degree of contact with the atmosphere communication membrane 47. Hence, when the ink jet head 16 has a large amount of ink consumption, then it is conceivable that there is some delay in the ink supply from the ink cartridge 10 to the ink jet head 16. From this point of view, when the printer 1 assumes the first posture, it is desirable for the sealing liquid 48 completely not to contact with the atmosphere communication membrane 47.

On the other hand, when the printer 1 assumes the second posture in FIG. 5, as depicted in FIG. 6B, the atmosphere connection body 46 assumes such a posture as to extend vertically such that the tapered fore-end portion may locate on the upper side. On this occasion, the seating liquid 48 stays in a lower part of the atmosphere connection body 46 (an end part where the atmosphere communication port 46*b* is formed). By virtue of this, the sealing liquid 48 covers the entire area of the atmosphere communication membrane 47 (the entire area for the part of the atmosphere communication membrane 47 to cover the atmosphere communication port 46*b*) on as to seal up the atmosphere communication membrane 47. Therefore, because the sealing liquid 48 shuts off the atmosphere communication of the ink retaining chamber 35 of the ink cartridge 10, it is not possible for the ink in ink retaining chamber 35 to flow out from the ink supply portion 33.

By virtue of this, when the printer 1 assumes the second posture, even when the plurality of nozzles 30 of the ink jet head 16 are positioned below the ink supply portion 33 of the ink cartridge 10 (the ink connection portion 43 of the cartridge installation portion 11), it is still not possible for the ink to flow out from the ink supply portion 33 to the ink jet head 16. By virtue of this, the ink is prevented from flowing out from the plurality of nozzles 30.

Further, in the first embodiment, as the sealing liquid 48 adapted to seal up the atmosphere communication membrane 47, such a mixture is used that a smaller amount of a solid constituent than the ink is mixed into the same liquid constituent as the ink. That is, because the ink and the sealing liquid 48 are made of the same material, the sealing liquid 48 has an advantage in manufacturing cost and the like.

However, when the sealing liquid 48 comes many times to adhere to the atmosphere communication membrane 47, then the color material, which is the solid constituent included in the sealing liquid 48, is liable to stick to the atmosphere communication membrane 47 such that the atmosphere communication membrane 47 may increase in the resistance against air ventilation and, furthermore, clogging may occur. In this regard, because the sealing liquid 48 has a smaller content of the color material than the ink, even when the sealing liquid 48 adheres to the atmosphere communication membrane 47, the color material is still less likely to stick to the atmosphere communication membrane 47, and thus clogging is less likely to occur in the atmosphere communication membrane 47.

Further, the sealing liquid 48 may be made of the same liquid constituent only as the ink, that is, it may not include the color material of the solid constituent. In such a case, even when the sealing liquid 48 comes many times to adhere to the atmosphere communication membrane 47, because the solid constituent never sticks thereto, clogging also never occurs in the atmosphere communication membrane 47. However, when the color material is not contained in the sealing liquid 48, then because the sealing liquid 48 is transparent, there is a demerit that at the stage of manufacturing or repairing, it is more difficult to determine whether or not the sealing liquid 48 is present in the atmosphere connection portion 44.

In addition, the color material of the ink may include other functions than giving a. particular color to the ink. For example, the solvent of the ink may affect a member in contact with the ink (for example, the cartridge body 32 of the ink cartridge 10) to exfoliate the contact surface of the member, etc. In order to prevent this from happening, the color material may incorporate such a constituent as to restrain the solvent from affecting the member in contact with the ink. In such a case, likewise, it is preferable to mix the color material into the solvent also for the sealing liquid 48 so as to restrain the solvent from affecting the liquid contact member.

Further, when the printer 1 is rotated 90 degrees from the first posture in the opposite direction from the second posture, then as understood from FIGS. 6A and 6B, the sealing liquid 48 is liable to fall down from the connection port 46*a* of the atmosphere connection body 46 so as to flow into the ink cartridge 10. Therefore, it is preferable to give cautions to users and the servicemen in charge of repair through the instruction manual, a sticker attached on the printer casing 2 and the like for the printer 1, such that the printer 1 may be turned from the horizontal first posture to the vertical second posture but should not assume the opposite vertical posture from the second posture.

<Second Embodiment>

Next, a second embodiment of the present teaching will be explained. In the second embodiment, however, the same reference numerals and signs are assigned to the components of sufficiently similar configurations to those in the first embodiment described above, and the explanation therefor will be omitted as appropriate. Further, FIG. 3 and FIG. 5 used in the first embodiment will also be used in the second embodiment for explaining the posture of the printer.

In the print system 100 in the first embodiment described above, the atmosphere connection portion 44 of the cartridge installation portion 11 is provided with a system for shutting off the atmosphere communication of the ink cartridge 10 when the printer 1 assumes the second posture. In the second embodiment, the atmosphere communication portion of the ink cartridge is provided with the same system.

Figure 7:
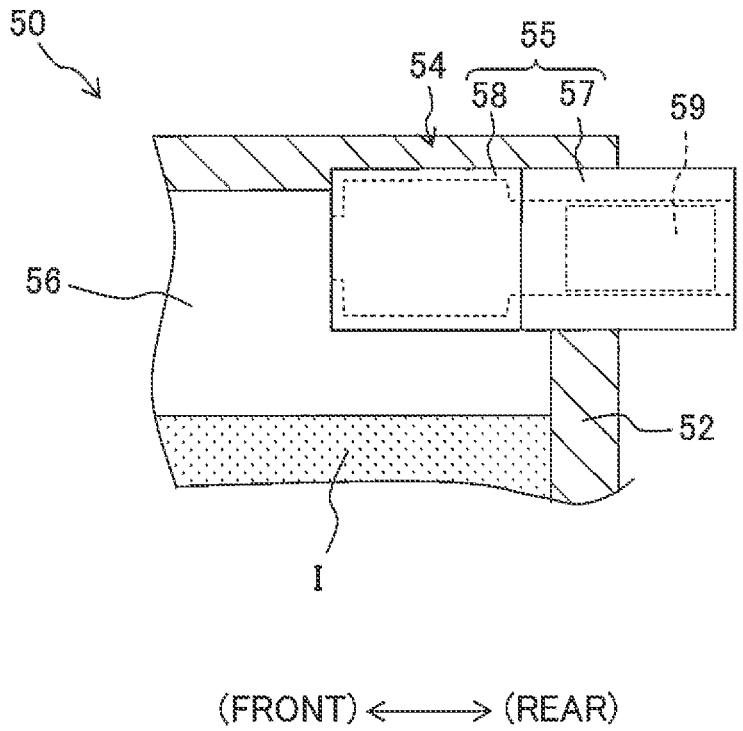
FIG. 7 is an enlarged view of a part of the ink cartridge including an atmosphere communication portion, according to a second embodiment of the present invention.

As depicted in FIG. 7, an ink cartridge 50 has an atmosphere communication portion 54 adapted to cause an ink retaining chamber 56 in a cartridge body 52 to communicate with the atmosphere. Further, the atmosphere communication portion 54 includes an atmosphere communication body 55 having a valve containment portion 57 and a liquid containment portion 58. An atmosphere communication valve 59 is contained in the valve containment portion 57. When the ink cartridge 50 is inserted into the cartridge installation portion 11 (see FIG. 3), the atmosphere connection portion 44 of the cartridge installation portion 11 opens the atmosphere communication valve 59. The liquid containment portion 58 is arranged on the left side of the valve containment portion 57, that is, on the side of the ink retaining chamber 56.

Figure 8A:
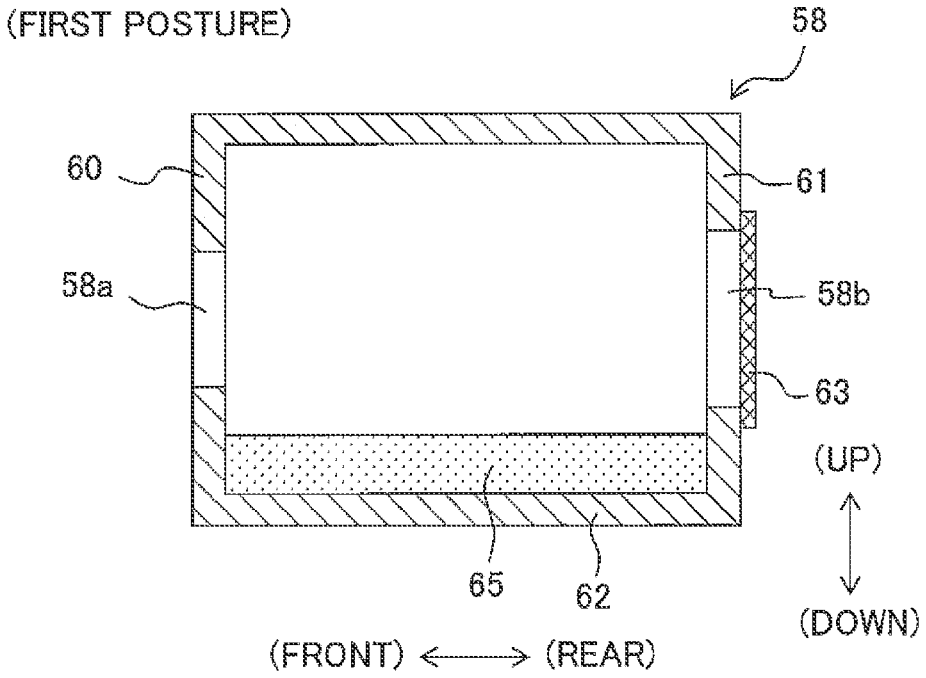
FIG. 8A is a cross-sectional view of a liquid containment portion of an atmosphere communication body on the ink cartridge side when the printer assumes the first posture.
Figure 8B:
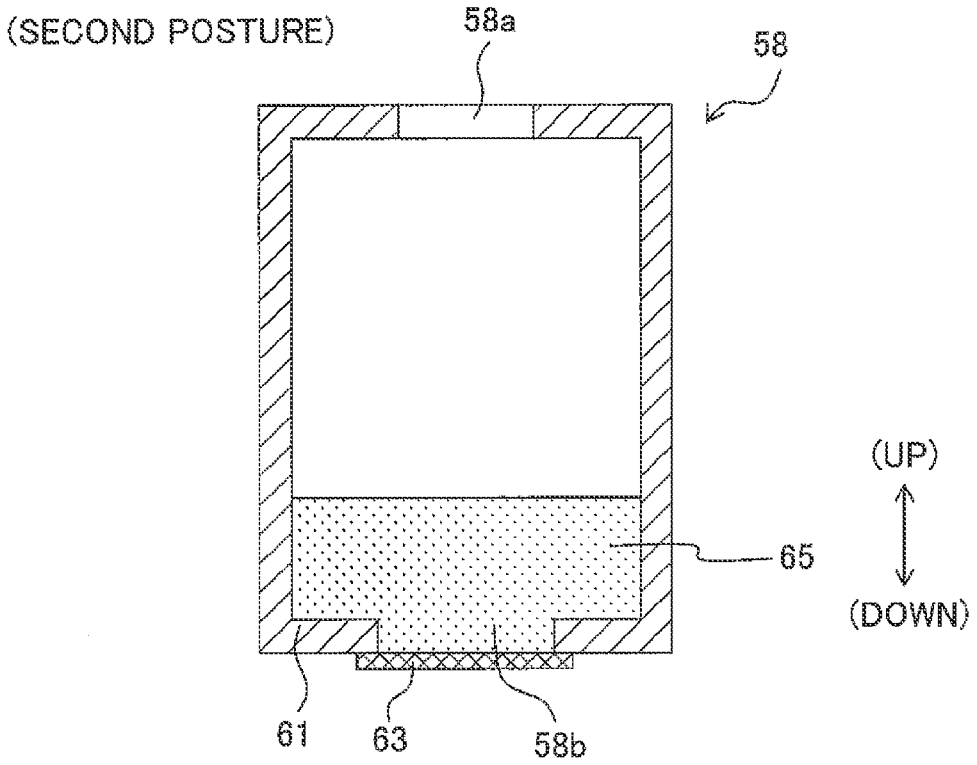
FIG. 8B is a cross-sectional view of the liquid containment portion of the atmosphere communication body on the ink cartridge side when the printer assumes the second posture.

As depicted in FIGS. 8A and 8B, a wall portion 60 on the front side separates the liquid containment portion 58 from the ink retaining chamber 56 in the cartridge body 52. A connection port 58*a* is formed in the wall portion 60 to let the ink retaining chamber 56 communicate with the internal space of the liquid containment portion 58 via the connection port 58*a*. Further, a wall portion 61 on the rear side separates the liquid. containment portion 58 from the valve containment portion 57. An atmosphere communication port 58*b* is formed in the wall portion 61 such that the internal space of the liquid containment portion 58 may communicate with the internal space of the valve containment portion 57 via the atmosphere communication port 58*b* and, furthermore, may communicate with the atmosphere.

On the wall portion 61 on the rear side of the liquid containment portion 58 (corresponding to the containment portion of the present teaching), an atmosphere communication membrane 63 is provided to block the atmosphere communication port 58*b*. Just as the atmosphere communication membrane 47 in the first embodiment, the atmosphere communication membrane 63 does not allow liquid to pass through but allows only gaseous matters to pass through. A sealing liquid 65 is contained in an internal space of the liquid containment portion 58. Just as the sealing liquid 48 in the first embodiment, the sealing liquid 65 is made by mixing a color material into the same solvent as that of the ink. The sealing liquid 65 has a smaller content of the color material, than the ink.

When the printer 1 assumes the first posture depicted in FIG. 1, the ink cartridge 50 assumes a first cartridge posture in which the ink supply portion 33 and the atmosphere communication portion 54 both turn sideways. On this occasion, as depicted in FIG. 8A, the sealing liquid 65 in the liquid containment portion 58 stays on a wall portion 62 which is the bottom of the atmosphere communication body 55, to locate below the connection port 58*a* and the atmosphere communication port 58*b*. That is, the sealing liquid 65 stays away from and does not contact with the atmosphere communication membrane 63 such that the atmosphere communication membrane 63 is not blocked by the sealing liquid 65. In this state, the ink retaining chamber 56 of the ink cartridge 50 is in communication with the atmosphere via the atmosphere communication membrane 63 such that it is possible for the ink in the ink retaining chamber 56 to flow out from the ink supply portion 33 toward the ink jet head 16.

On the other hand, when the printer 1 assumes the second posture depicted in FIG. 5, the ink cartridge 50 assumes a second cartridge posture in which the ink supply portion 33 and the atmosphere communication portion 54 both turn to the downside. On this occasion, as depicted in FIG. 8B, the sealing liquid 65 in the liquid containment portion 58 stays on the wall portion 61 which is the bottom of the atmosphere communication body 55 and, by virtue of this, the sealing liquid 65 covers the entire area of the atmosphere communication membrane 63 so as to seal up the atmosphere communication membrane 63. Therefore, because the sealing liquid 65 shuts off the atmosphere communication of the ink retaining chamber 56 of the ink cartridge 50, the ink in ink retaining chamber 56 will no longer flow out from the ink supply portion.

Further, in the second embodiment, the sealing liquid 65 is contained in the liquid containment portion 58 of the ink cartridge 50, separated from the ink retaining chamber 56. That is, even when the ink in the ink retaining chamber 56 is consumed and little of the ink remains, being completely independent from the remaining ink, the sealing liquid 65 keeps on staying in the liquid containment portion 58. That is, regardless of the remaining ink in the ink cartridge 50, it is possible for the sealing liquid 65 to seal up the atmosphere communication membrane 63.

Further, just as the first embodiment described earlier on, as the sealing liquid 65 adapted to seal up the atmosphere communication membrane 63, because such a mixture is used that a smaller amount of the color material (the solid constituent) than the ink is mixed into the same liquid constituent as the ink, there is an advantage in manufacturing cost and the like. Further, because the sealing liquid 65 has a smaller content of the color material than the ink, the color material is less likely to stick to the atmosphere communication membrane 63, and thus clogging is less likely to occur in the atmosphere communication membrane 63.

Further, in the second embodiment, the ink cartridge 50 is provided with a structure capable of sealing up the atmosphere communication membrane 63. Therefore, even after being removed from the printer 1, the ink cartridge 50 still has the following effects. That is, more or less of the ink may still remain in the ink cartridge 50 being used up. Therefore, after removing the ink cartridge 50 from the printer 1, when the ink cartridge 50 resumes such a posture as to turn the ink supply portion 33 to the downside (the second cartridge posture), then it is possible for the remaining ink to drop down from the ink supply portion 33. In this regard, in the second embodiment, when the ink cartridge 50 assumes the second cartridge posture, the sealing liquid 65 seals up the atmosphere communication membrane 63 in the atmosphere communication portion 54. That is, in the second cartridge posture, because the atmosphere communication of the ink retaining chamber 56 is shut off, even when the ink supply portion 33 turns to the downside, the remaining ink is still less likely to drop down.

Next, explanations will be made on a few modifications having applied various changes to the first embodiment and the second embodiment. Further, while the following explanations may be made by exemplifying modifications of the first embodiment, it is also possible to apply the same changes to the second embodiment. Further, in the following explanations, the same reference numerals and signs are assigned to the components of similar configurations to those in the first embodiment (or the second embodiment), and the explanation therefor will be omitted as appropriate.

<First Modification>

The sealing liquids are not limited to those described in the first and second embodiments. For example, as mentioned a little earlier on, the sealing liquid 48 (65) may be completely the same as the ink.

Alternatively, the sealing liquid 48 (65) may have a liquid constituent different from the ink. The sealing liquid 48 (65) of the atmosphere connection portion 44 of the cartridge installation portion 11 (or the atmosphere communication portion 54 of the ink cartridge 50) is in constant contact with air. Therefore, it is conceivable that after a long period of time, the sealing liquid 48 (65) may decrease in quantity through volatilization. In some cases, it is also conceivable that the sealing liquid 48 (65) may finally vanish away through volatilization. Therefore, the sealing liquid 48 (65) may have such a liquid constituent with a lower volatility than the ink solvent. For example, when a solvent of which primary constituent is water is used for the ink, then glycerin of which volatility is lower than water may be mixed more into the liquid constituent of the sealing liquid than into the ink. In this manner, as the sealing liquid 48 (65) has a lower volatility than the ink, the sealing liquid 48 (65) becomes less likely to vanish away through volatilization. By virtue of this, it is possible to maintain the sealing function of the atmosphere communication membrane 47 (63) for a long period of time.

<Second Modification>

When the printer 1 assumes the second posture, it is desirable for the sealing liquid 48 (65) not to depart from the atmosphere communication membrane 47 (63) but to constantly cover the entire area of the atmosphere communication membrane 47 (63). However, it is conceivable that some vibration may he exerted on the printer 1 in transportation or the like to cause the sealing liquid 48 (65) to undulate and thus temporarily depart from the atmosphere communication membrane 47 (63).

Figure 9:
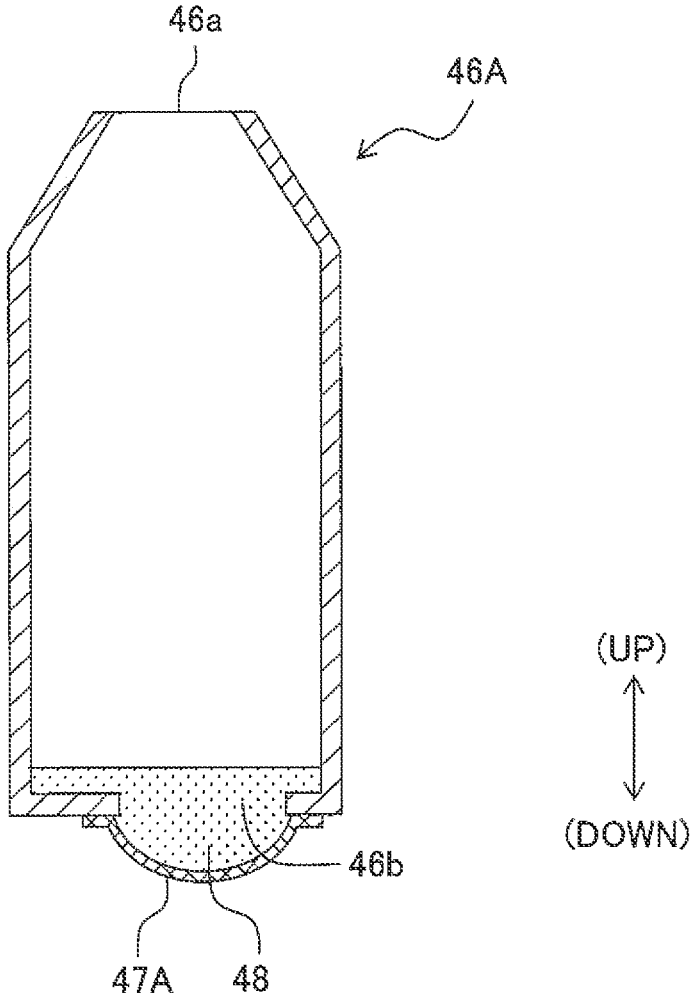
FIG. 9 is a cross-sectional view of an atmosphere connection portion according to a modification of the embodiments.

Therefore, as depicted in FIG. 9 for example, when the printer 1 assumes the second posture, an atmosphere communication membrane 47A may have a downward convex shape. Hence, the atmosphere communication membrane 47A may be formed into a convex shape from the beginning to keep an outward convex shape regardless of the posture of the printer 1. Alternatively, the atmosphere communication membrane 47A may be configured to become downwardly convex by letting its central portion droop because of its own weight and the weight of the sealing liquid 48 when the printer 1 assumes the second posture. In this form, the sealing liquid 48 is stably retained in the inside of the convex atmosphere communication membrane 47A. Therefore, even when some vibration is exerted on the sealing liquid 48, the sealing liquid 48 is still less likely to depart from the atmosphere communication membrane 47A, thereby preventing the atmosphere communication membrane 47 from exposure.

<Third Modification>

When the printer 1 assumes the first posture, and when the sealing liquid 48 (65) is also in contact with the atmosphere communication membrane 47 (63), then air is prevented from flowing in from the atmosphere communication port 46*b* (58*h*). Therefore, when the printer 1 assumes the first posture, it is preferable for the sealing liquid 48 (65) not to contact with the atmosphere communication membrane 47 (63). Further, when the printer 1 is not in use, even when the sealing liquid 48 (65) is not in contact with the atmosphere communication membrane 47 (63), it is still conceivable that due to some vibration and the like when the printer 1 is in operation, the sealing liquid 48 (65) may undulate and thus come to contact with the atmosphere communication membrane 47 (63). Then, when the sealing liquid 48 (65) includes a solid constituent such as a color material and the like, and when the sealing liquid 48 (65) has many changes to contact with the atmosphere communication membrane 47 (63), then the solid constituent is liable to stick to a part of the atmosphere communication membrane 47 (63) to increase the resistance against air ventilation and, finally, to give rise to clogging of that part.

Figure 10:
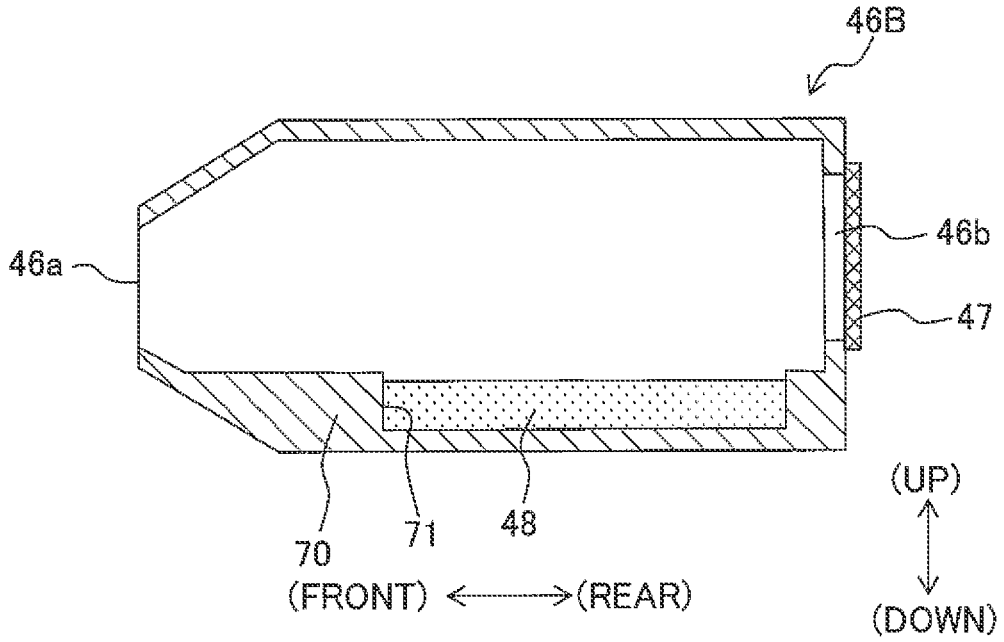
FIG. 10 is a cross-sectional view of an atmosphere connection portion according to another modification.

Hence, as depicted in FIG. 10 for example, a recess 71 may be formed in a portion 70 which is the bottom of an atmosphere connection body 46B when the printer 1 assumes the first posture. In this configuration, when the printer 1 assumes the first posture, the sealing liquid 48 is retained in the recess 71 of the atmosphere connection body 46B. Therefore, in case that some vibration or the like is exerted, the sealing liquid 48 is prevented from moving in the atmosphere connection body 46B so as to contact with the atmosphere communication membrane 47. Further, when a large quantity of the sealing liquid 48 is there, and thus overflows from the recess 71, then the overflowed part is likely to contact with the atmosphere communication membrane 47. Therefore, it is preferable for the sealing liquid 48 to have a smaller quantity than the inner volume of the recess 71.

<Fourth Modification>

Figure 11:
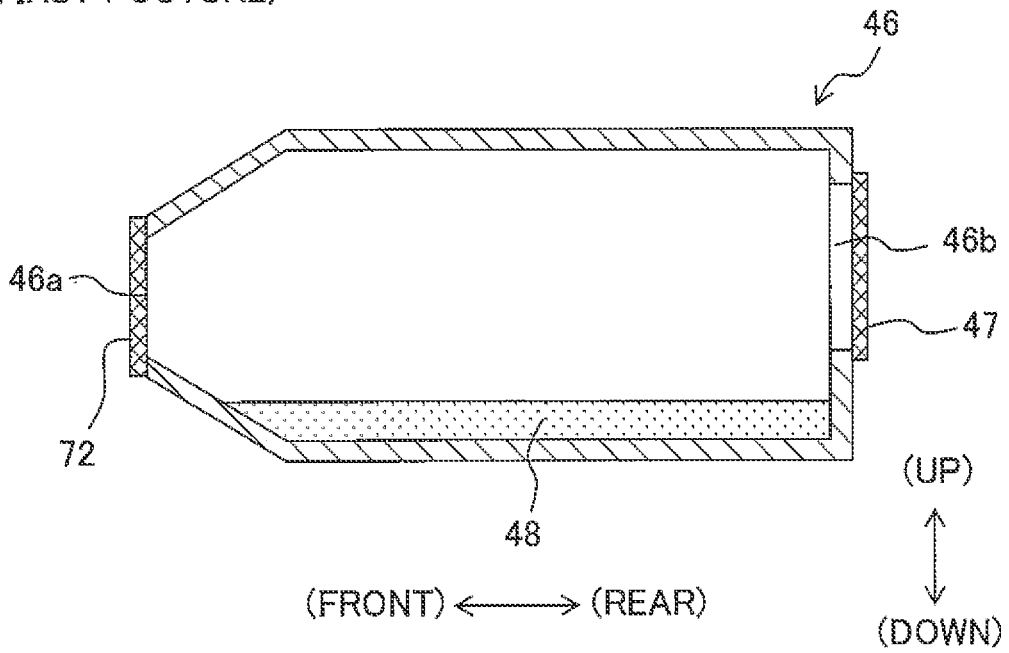
FIG. 11 is a cross-sectional view of an atmosphere connection portion according to still another modification.

As depicted in FIG. 11, a liquid outflow prevention membrane 72 may be provided on the connection port 46*a* of an atmosphere connection body 46C, which is the communication part with the ink retaining chamber 35 of the ink cartridge 10, to allow gaseous matters alone to pass through so as to prevent the sealing liquid 48 from flowing out to the ink cartridge 10. It is possible to use the same material as the atmosphere communication membrane 47 for the liquid outflow prevention membrane 72. In this manner, by providing the liquid outflow prevention membrane 72 on the connection port 46*a* of the atmosphere connection body 46C, even when the printer 1 is supposed to assume the vertical posture turning the second posture upside down (the posture in which the paper discharge portion 5 in FIG. 1 is on the downside), the sealing liquid 48 in the atmosphere connection body 46C is still prevented from flowing out to the ink cartridge 10 to vanish away. Further, because the liquid outflow prevention membrane 72 allows gaseous matters to pass through, the liquid outflow prevention membrane 72 never impedes the ink retaining chamber 35 of the ink cartridge 10 from the communication with the atmosphere.

<Fifth Modification>

Figure 12:
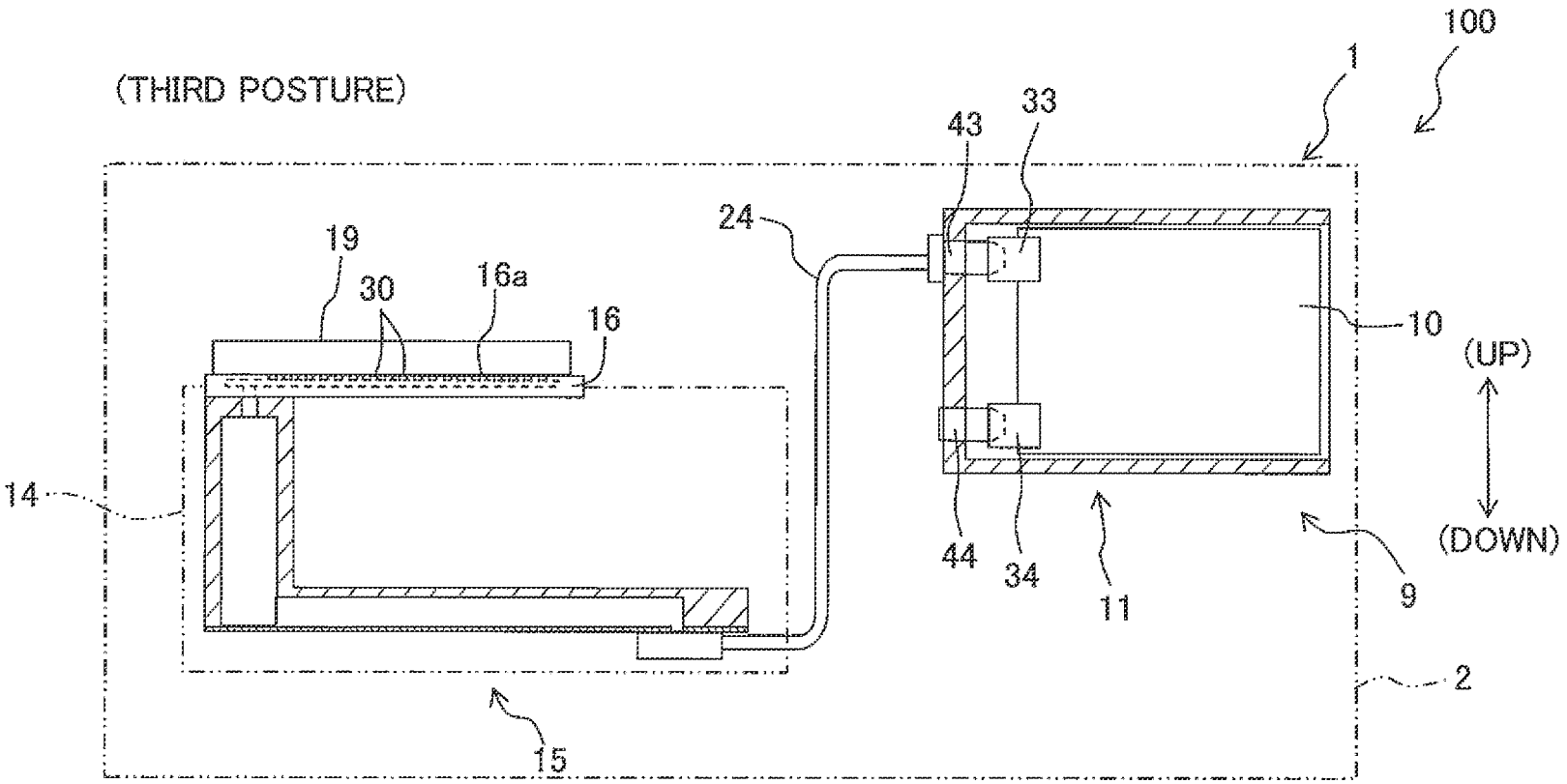
FIG. 12 is a lateral view of the main part of the printer assuming a third posture which turns the first posture upside down.

It is possible for the printer 1 to assume other postures than the first posture and the second posture described above. As depicted in FIG. 12 for example, in addition to the first posture and the second posture, the printer 1 is further supposed to possibly assume a third posture which turns the first posture upside down (the upside is turned 180 degrees to the downside). In the third posture, just as in the second posture, the plurality of nozzles 30 of the ink jet surface 16*a* of the ink jet head 16 are positioned below the ink supply portion 33 of the ink cartridge 10 (the ink connection portion 43 of the cartridge installation portion 11). Therefore, when the printer 1 assumes the third posture, because the ink is liable to leak out from each of the nozzles 30, it is preferable to shut off the atmosphere communication of the ink cartridge 10.

Figure 13A:
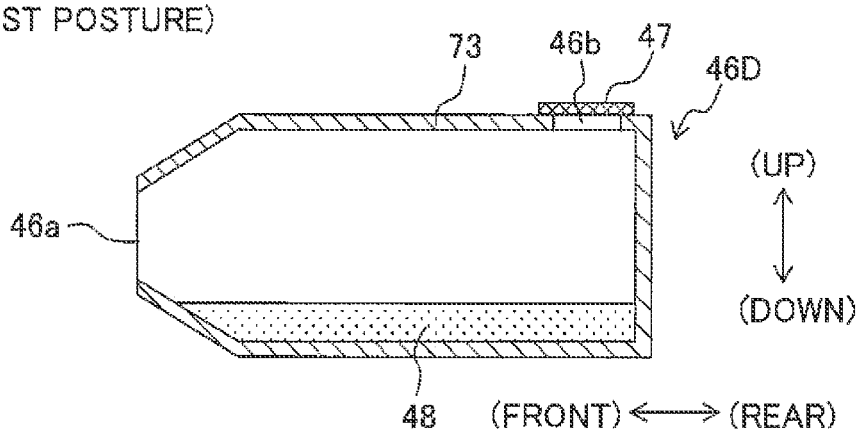
FIGS. 13A to 13C are cross-sectional views of an atmosphere connection portion according to still another modification.

With respect to the above description, as depicted in FIG. 13A, the atmosphere communication port 46*h* and the atmosphere communication membrane 47 may be provided in such an end portion (a rear end portion here) of a wall portion 73, which is the ceiling portion of an atmosphere connection body 46D when the printer 1 assumes the first posture, as on one side according to the front-rear direction. Further, the "rear side" in FIG. 13A is, as understood from FIG. 13B, directed to the "lower side" when the printer 1 assumes the second posture.

Figure 13B:
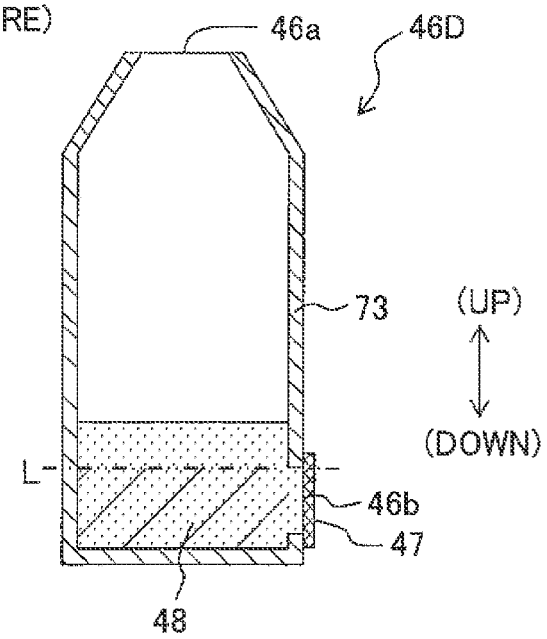

First, as depicted in FIG. 13B, when the printer 1 assumes the second posture, the end portion of the wall portion 73 of the atmosphere connection body 46D, where the atmosphere communication membrane 47 is provided, becomes a lower end portion of the atmosphere connection body 46D. Therefore, the atmosphere communication membrane 47 is sealed up by the sealing liquid 48 retained in the lower end portion of the atmosphere connection body 46D. Further, in FIG. 13B, in order to let the sealing liquid 48 cover the entire area of such a part of the atmosphere communication membrane 47 as covering the atmosphere communication port 46*b*, the sealing liquid 48 contained in the atmosphere connection body 46D needs to have a volume not less than an inner volume V (the volume hatched by the diagonal lines) of the atmosphere connection body 46D from the bottom to the upper end of the atmosphere communication port 46*h* indicated by the two-dot chain line L.

Figure 13C:
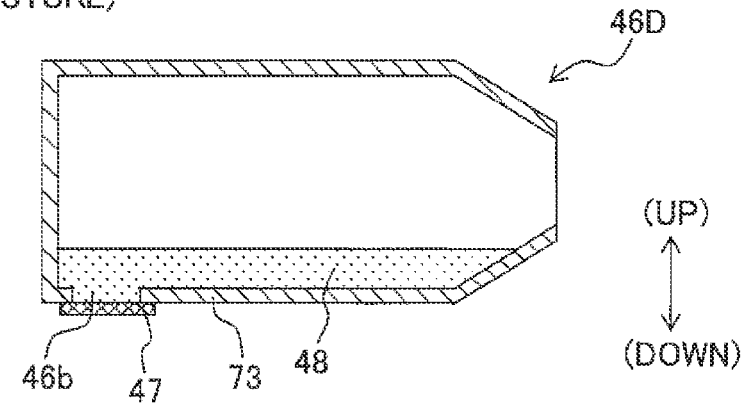

Further, as depicted in FIG. 13C, when the printer 1 assumes the third posture turning the first posture upside down, because the wall portion 73 of the atmosphere connection body 46D becomes a bottom portion, the sealing liquid 48 retained in the bottom portion covers the entire area of the atmosphere communication membrane 47 to seal up the atmosphere communication membrane 47.

In this manner, it is possible for the configuration of FIGS. 13A to 13C to shut off the atmosphere communication of the ink cartridge by letting the sealing liquid 48 block the atmosphere communication membrane 47 whether the printer 1 assumes the second posture or the third posture turning the first posture upside down.

Further, in FIG. 6A of the first embodiment, the wall portion of the atmosphere connection body 46 on the right side is provided with the atmosphere communication port 46*b* and the atmosphere communication membrane 47 when the printer 1 assumes the first posture. In the first embodiment, based on the same concept as in the configuration of FIGS. 13A to 13C, it is desirable to provide the atmosphere communication port 46*b* and the atmosphere communication membrane 47 in, especially; an upper end part of the wall portion on the right side in FIG. 6A. By virtue of this, with the configuration of FIGS. 6A and 6B, whether the printer 1 assumes the second posture or the third posture turning the first posture upside down, it is still possible for the sealing liquid 48 to seal up the atmosphere communication membrane 47.

Figure 14:
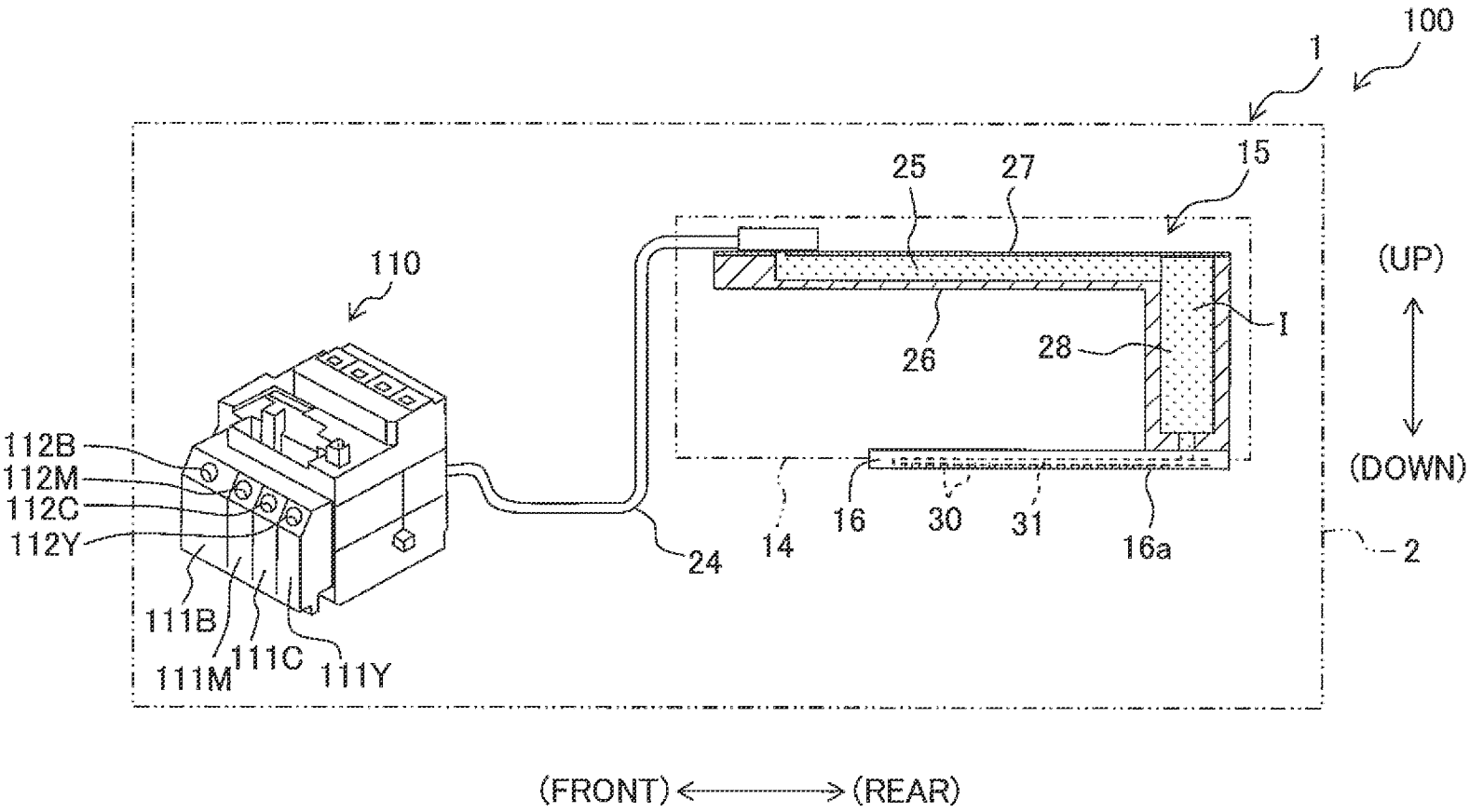
FIG. 14 is a schematic view of the printer including ink tank.

In the above description, the printer 1 includes four cartridge installation portions 11 in which ink cartridges 10 are installed respectively for four colors (black, yellow, cyan, and magenta). However, the present teaching is not limited to such configurations. For example, as depicted in FIG. 14, in place of the ink cartridges 10 and the cartridge installation portions 11, the printer 1 may include an ink tank 110 of a large capacity which is refillable with ink and which is fixed to the printer 1 such that it can not be removed easily from the printer 1. An internal space of the ink tank 110 is partitioned into four ink chambers 111B, 111M, 111C, and 111Y which are adjacent in the scanning direction. Inlets 112B, 112M, 112C, and 112Y for allowing the ink to flow into the ink chambers 111B, 111M, 111C, and 111Y are formed in the four ink chambers 111B, 111M, 111C, and 111Y, respectively. Accordingly, it is possible to refill the ink into the ink chamber 111B, 111M, 111C, and 111Y. In this case, the atmosphere communication portion 34 can be adopted to the ink tank 110, in the same way.

In the first and second embodiments and their modifications explained above, the present teaching is applied to an ink jet printer which jets ink to recording paper to print images and the like thereon. However, the present teaching may also be applied to any liquid discharge apparatus used for various purposes other than printing images and the like. For example, it is also possible to apply the present teaching to liquid discharge apparatuses which jet an electrically conductive liquid to a substrate to form a conductive pattern on a surface of the substrate.

As described above, according to the present teaching, the sealing liquid seals up the atmosphere communication membrane. Here, the liquid does not have a certain shape but can freely change its shape according to the container's shape. According to the present teaching, because the sealing liquid is used, no matter how the containment portion changes in shape, the sealing liquid can still change its shape according to the shape of the containment portion. Therefore, it is possible to determine the shape of the containment portion in a comparatively free manner. Further, according to the present teaching, because it is possible to take such a convenient or easy configuration as to enclose the sealing liquid into the containment portion, it is not necessary to form a complicated shape of the component including the containment portion.

What is claimed is:

1. A liquid discharge apparatus configured to discharge first liquid, comprising:

a liquid jet head in which a plurality of nozzles are formed to jet the first liquid; and a liquid supply unit configured to supply the first liquid to the liquid jet head, and including:

a liquid connection portion through which the first liquid is supplied to the liquid jet head; and an atmosphere connection portion through which the first liquid in the liquid supply unit is communicated with the atmosphere;

wherein the atmosphere connection portion includes:

a containment portion which communicates with the liquid supply unit and in which an atmosphere communication port is formed;

an atmosphere communication membrane provided in the containment portion to block the atmosphere communication port and to allow only gaseous matters to pass through; and a second liquid contained in the containment portion, of which amount is set such that the second liquid does not cover an entire area of the atmosphere communication membrane under a condition that the liquid discharge apparatus assumes a first posture in which the nozzles of the liquid jet head are positioned above the liquid connection portion, and that the second liquid covers the entire area of the atmosphere communication membrane under a condition that the liquid discharge apparatus assumes a second posture in which the nozzles of the liquid jet head are positioned below the liquid connection portion.

2. The liquid discharge apparatus according to claim 1;

wherein the liquid supply unit includes a cartridge installation portion which is connected with the liquid jet head, and is configured to install a liquid cartridge in which the first liquid is retained.

3. The liquid discharge apparatus according to claim 1;

wherein the liquid supply unit includes a liquid tank which is connected with the liquid jet head and in which the first liquid is retained.

4. The liquid discharge apparatus according to claim 1 wherein the first liquid is a mixture of a liquid constituent and a solid constituent;

wherein the second liquid includes the liquid constituent; and wherein the solid constituent which are same as the first liquid, and includes a less content of the solid constituent than the first liquid.

5. The liquid discharge apparatus according to claim 1;

wherein the second liquid has a lower volatility than the first liquid.

6. The liquid discharge apparatus according to claim 5;

wherein the first liquid is an ink containing water, glycerin, and a color material;

wherein the second liquid is a liquid containing water, glycerin, and the color material; and wherein the glycerin contained in the second liquid has a higher content rate than the glycerin contained in the first liquid.

7. The liquid discharge apparatus according to claim 1;

wherein the atmosphere communication membrane has a downwardly convex shape under a condition that the liquid discharge apparatus assumes the second posture.

8. The liquid discharge apparatus according to claim 1;

wherein a recess is formed in such a part of the containment portion as to become a bottom portion under a condition that the liquid discharge apparatus assumes the first posture, to retain the second liquid.

9. The liquid discharge apparatus according to claim 1;

wherein the atmosphere connection portion includes a liquid outflow prevention membrane provided in such a part of the containment portion to communicate with the liquid cartridge, to allow only gaseous matters to pass through such that the second liquid is prevented from flowing out from the containment portion to the liquid cartridge.

10. The liquid discharge apparatus according to claim 9;

wherein the atmosphere communication membrane and the liquid outflow prevention membrane seal up the internal space of the containment portion of the atmosphere connection portion such that no liquid communicate with the outside of the containment portion.

11. The liquid discharge apparatus according to claim 10;

wherein the atmosphere communication membrane and the liquid outflow prevention membrane are formed of the same material of membrane.

12. The liquid discharge apparatus according to claim 1;

wherein the atmosphere communication membrane is provided in an end portion of such a part of the containment portion, on one side according to a horizontal first direction, as to become a ceiling portion under a condition that the liquid discharge apparatus assumes the first posture; and under a condition that the liquid discharge apparatus assumes the second posture, the end portion of the containment portion, at which the atmosphere communication membrane is provided, becomes a lower end portion of the containment portion.

13. The liquid discharge apparatus according to claim 1;

wherein the containment portion includes a tapered portion formed at one end of the containment portion, and an opening is formed at a tapered tip of the tapered portion; and wherein a tapered angle of the tapered portion is set such that the second liquid in the containment portion does not reach the opening at the tapered tip, under a condition that the liquid discharge apparatus assumes the first posture.

14. A liquid cartridge to be installed in a liquid discharge apparatus including a liquid jet head having a plurality of nozzles jetting a first liquid, the liquid cartridge comprising:

a cartridge body in which a liquid retaining chamber is formed to retain the first liquid;

a liquid supply portion provided in the cartridge body and configured to supply a liquid to the liquid discharge apparatus; and an atmosphere communication portion provided in the cartridge body to cause the liquid retaining chamber in the cartridge body to communicate with the atmosphere;

wherein the atmosphere communication portion includes:

a containment portion which communicates with the liquid retaining chamber in the cartridge body and in which an atmosphere communication port is formed;

an atmosphere communication membrane provided in the containment portion to block the atmosphere communication port; and a second liquid contained in the containment portion, of which amount is set such that the second liquid does not cover an entire area of the atmosphere communication membrane under a condition that the liquid discharge apparatus assumes a first posture in which the nozzles of the liquid jet head are positioned above the liquid supply portion, and that the second liquid covers the entire area of the atmosphere communication membrane under a condition that the liquid discharge apparatus assumes a second posture in which the nozzles of the liquid jet head are positioned below the liquid supply portion.

15. The liquid cartridge according to claim 14;

wherein the first liquid is a mixture of a liquid constituent and a solid constituent;

wherein the second liquid includes the liquid constituent; and wherein the solid constituent which are same as the first liquid, and includes a less content of the solid constituent than the first liquid.

16. The liquid cartridge according to claim 14;

wherein the first liquid is an ink containing water, glycerin, and a color material;

wherein the second liquid is a liquid containing water, glycerin, and the color material; and wherein the glycerin contained in the second liquid has a higher content rate than the glycerin contained in the first liquid.

17. A liquid discharge system comprising:

the liquid cartridge according to claim 14;

a liquid jet head having a plurality of nozzles to jet the first liquid; and a cartridge installation portion being connected with the liquid jet head and configured to install the liquid cartridge;

wherein the liquid cartridge installed in the cartridge installation portion assumes the first cartridge posture under a condition that the liquid discharge apparatus assumes a first posture in which the nozzles of the liquid jet head are positioned above the liquid connection portion of the cartridge installation portion, whereas the liquid cartridge installed in the cartridge installation portion assumes the second cartridge posture under a condition that the liquid discharge apparatus assumes a second posture in which the nozzles of the liquid jet head are positioned below the liquid connection portion of the cartridge installation portion.

* * * * *